US009944089B2

(12) United States Patent
Tanaka

(10) Patent No.: US 9,944,089 B2
(45) Date of Patent: Apr. 17, 2018

(54) IMAGE FORMING APPARATUS AND IMAGE FORMING METHOD

(71) Applicant: Hiroki Tanaka, Kanagawa (JP)

(72) Inventor: Hiroki Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/153,898

(22) Filed: May 13, 2016

(65) Prior Publication Data

US 2016/0339720 A1 Nov. 24, 2016

(30) Foreign Application Priority Data

May 19, 2015 (JP) ..... 2015-102108

(51) Int. Cl.
*B41J 3/36* (2006.01)

(52) U.S. Cl.
CPC ..... *B41J 3/36* (2013.01)

(58) Field of Classification Search
CPC ..... B41J 29/02; B41J 3/4075; B41J 11/0045; B41J 3/36; B41J 29/00; B41J 29/393; B41J 2/04505; B41J 2/04586
See application file for complete search history.

(56) References Cited

U.S. PATENT DOCUMENTS 8,240,801 B2 8/2012 Bledsoe et al.
9,141,893 B2 9/2015 Yamaguchi et al.
2011/0109678 A1* 5/2011 Schwartz ..... B41J 3/36 347/14
2012/0293580 A1* 11/2012 Bledsoe ..... B41J 3/36 347/14
2016/0082719 A1 3/2016 Harada et al.

FOREIGN PATENT DOCUMENTS

JP 2009-208291 9/2009
JP 2010-522650 7/2010
JP 2013-195691 9/2013

* cited by examiner

*Primary Examiner* — Jannelle M Lebron
(74) *Attorney, Agent, or Firm* — IPUSA, PLLC

(57) ABSTRACT

An image forming apparatus includes a displacement detecting unit that detects a displacement of the image forming apparatus with respect to a first direction and a second direction that are parallel to a surface of a print medium when the image forming apparatus moves away from a first position, a skew information acquiring unit that acquires skew information of the image forming apparatus at the first position based on the displacement of the image forming apparatus, and a skew controlling unit that controls skewing of an image to be formed on the print medium based on the skew information of the image forming apparatus, the skewing of the image occurring when the image forming apparatus is skewed with respect to the print medium at the first position. The image forming apparatus further includes an image forming unit that forms the image skew-controlled by the skewing controlling unit.

12 Claims, 19 Drawing Sheets

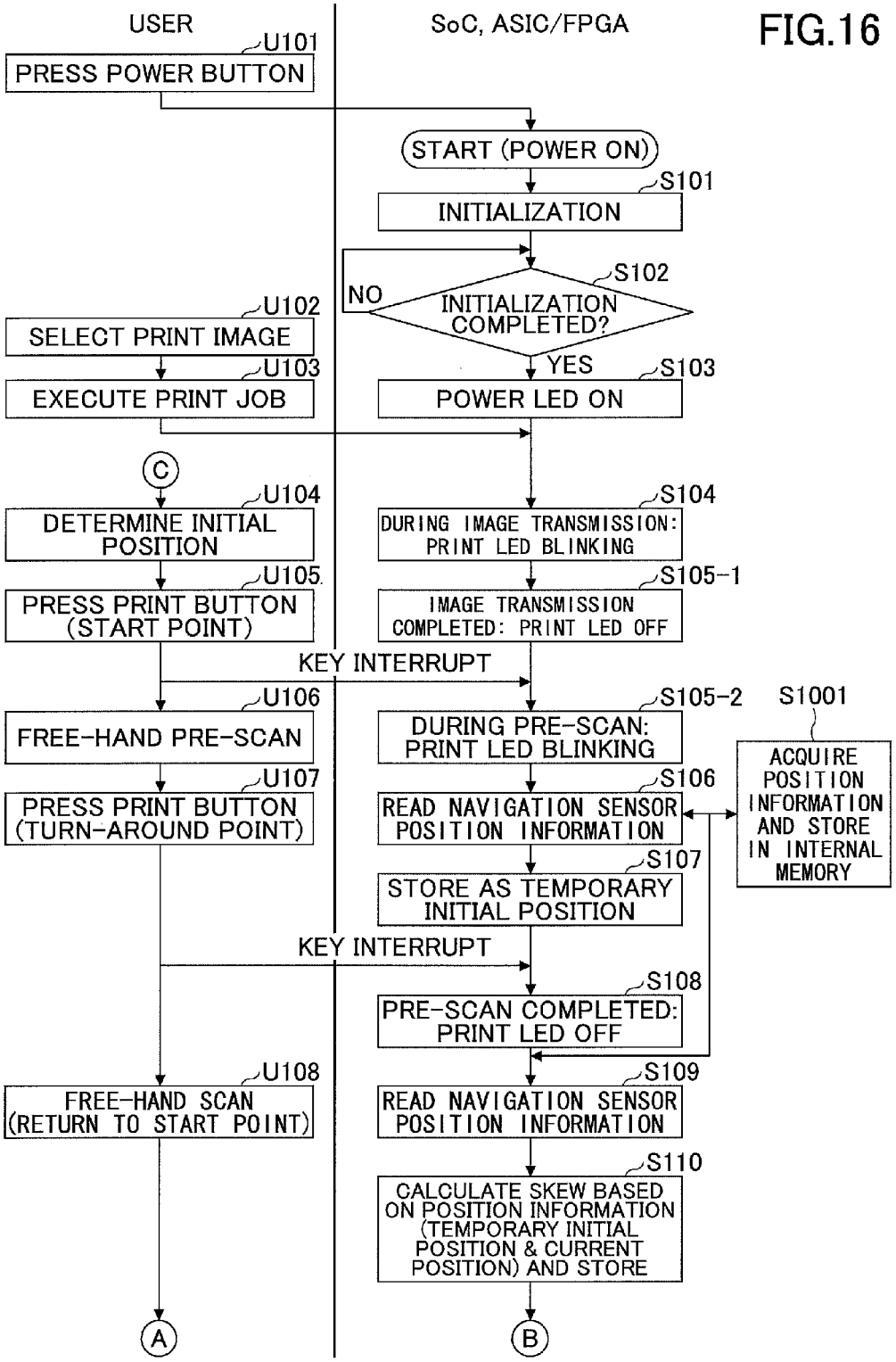
USER
SoC, ASIC/FPGA
FIG.16
U101
PRESS POWER BUTTON
START (POWER ON)
S101
INITIALIZATION
S102
NO
INITIALIZATION COMPLETED?
YES
U102
SELECT PRINT IMAGE
U103
EXECUTE PRINT JOB
S103
POWER LED ON
C
U104
DETERMINE INITIAL POSITION
S104
DURING IMAGE TRANSMISSION: PRINT LED BLINKING
U105
PRESS PRINT BUTTON (START POINT)
S105-1
IMAGE TRANSMISSION COMPLETED: PRINT LED OFF
KEY INTERRUPT
U106
FREE-HAND PRE-SCAN
S105-2
DURING PRE-SCAN: PRINT LED BLINKING
S1001
ACQUIRE POSITION INFORMATION AND STORE IN INTERNAL MEMORY
U107
PRESS PRINT BUTTON (TURN-AROUND POINT)
S106
READ NAVIGATION SENSOR POSITION INFORMATION
S107
STORE AS TEMPORARY INITIAL POSITION
KEY INTERRUPT
S108
PRE-SCAN COMPLETED: PRINT LED OFF
U108
FREE-HAND SCAN (RETURN TO START POINT)
S109
READ NAVIGATION SENSOR POSITION INFORMATION
S110
CALCULATE SKEW BASED ON POSITION INFORMATION (TEMPORARY INITIAL POSITION & CURRENT POSITION) AND STORE
A
B

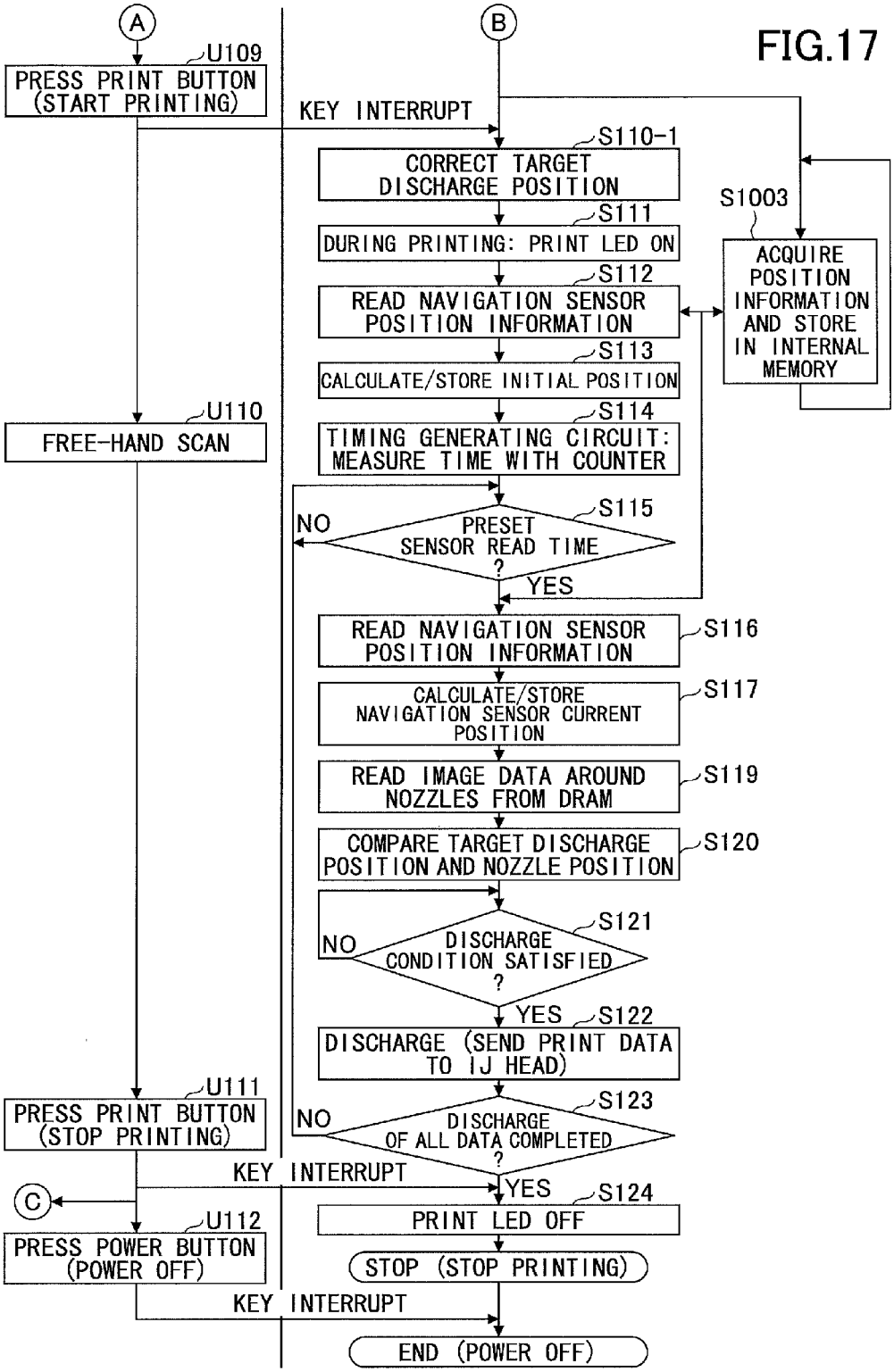
FIG.17
A
B
U109
PRESS PRINT BUTTON (START PRINTING)
KEY INTERRUPT
S110-1
CORRECT TARGET DISCHARGE POSITION
S111
DURING PRINTING: PRINT LED ON
S112
READ NAVIGATION SENSOR POSITION INFORMATION
S113
CALCULATE/STORE INITIAL POSITION
S114
TIMING GENERATING CIRCUIT: MEASURE TIME WITH COUNTER
S1003
ACQUIRE POSITION INFORMATION AND STORE IN INTERNAL MEMORY
U110
FREE-HAND SCAN
S115
PRESET SENSOR READ TIME ?
NO
YES
S116
READ NAVIGATION SENSOR POSITION INFORMATION
S117
CALCULATE/STORE NAVIGATION SENSOR CURRENT POSITION
S119
READ IMAGE DATA AROUND NOZZLES FROM DRAM
S120
COMPARE TARGET DISCHARGE POSITION AND NOZZLE POSITION
S121
DISCHARGE CONDITION SATISFIED ?
NO
YES
S122
DISCHARGE (SEND PRINT DATA TO IJ HEAD)
U111
PRESS PRINT BUTTON (STOP PRINTING)
S123
DISCHARGE OF ALL DATA COMPLETED ?
NO
YES
KEY INTERRUPT
C
S124
PRINT LED OFF
U112
PRESS POWER BUTTON (POWER OFF)
STOP (STOP PRINTING)
KEY INTERRUPT
END (POWER OFF)

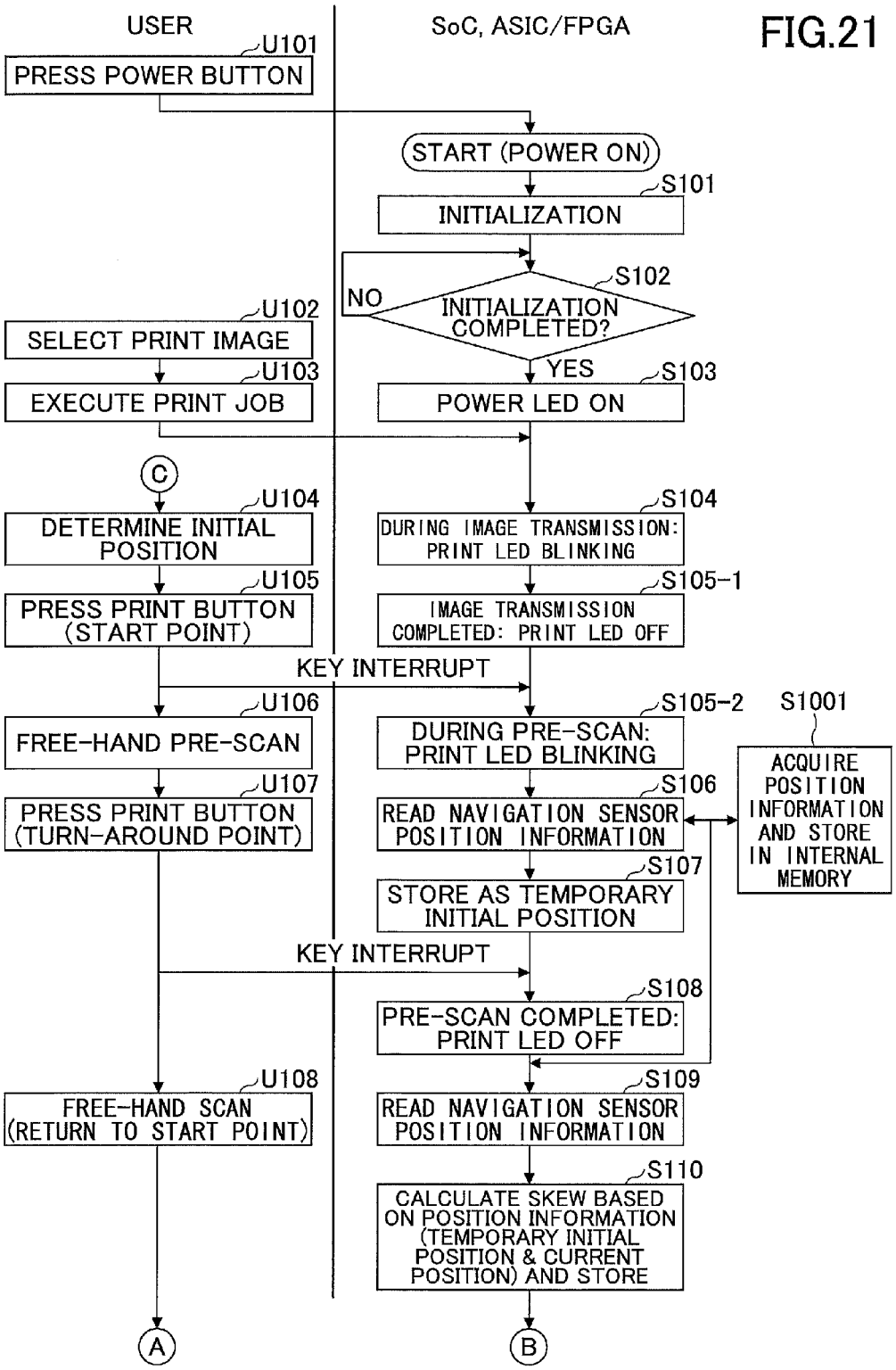
USER
SoC, ASIC/FPGA
FIG.21
U101
PRESS POWER BUTTON
START (POWER ON)
S101
INITIALIZATION
S102
NO
INITIALIZATION COMPLETED?
YES
U102
SELECT PRINT IMAGE
U103
EXECUTE PRINT JOB
S103
POWER LED ON
C
U104
DETERMINE INITIAL POSITION
S104
DURING IMAGE TRANSMISSION: PRINT LED BLINKING
U105
PRESS PRINT BUTTON (START POINT)
S105-1
IMAGE TRANSMISSION COMPLETED: PRINT LED OFF
KEY INTERRUPT
U106
FREE-HAND PRE-SCAN
S105-2
DURING PRE-SCAN: PRINT LED BLINKING
S1001
ACQUIRE POSITION INFORMATION AND STORE IN INTERNAL MEMORY
U107
PRESS PRINT BUTTON (TURN-AROUND POINT)
S106
READ NAVIGATION SENSOR POSITION INFORMATION
S107
STORE AS TEMPORARY INITIAL POSITION
KEY INTERRUPT
S108
PRE-SCAN COMPLETED: PRINT LED OFF
U108
FREE-HAND SCAN (RETURN TO START POINT)
S109
READ NAVIGATION SENSOR POSITION INFORMATION
S110
CALCULATE SKEW BASED ON POSITION INFORMATION (TEMPORARY INITIAL POSITION & CURRENT POSITION) AND STORE
A
B

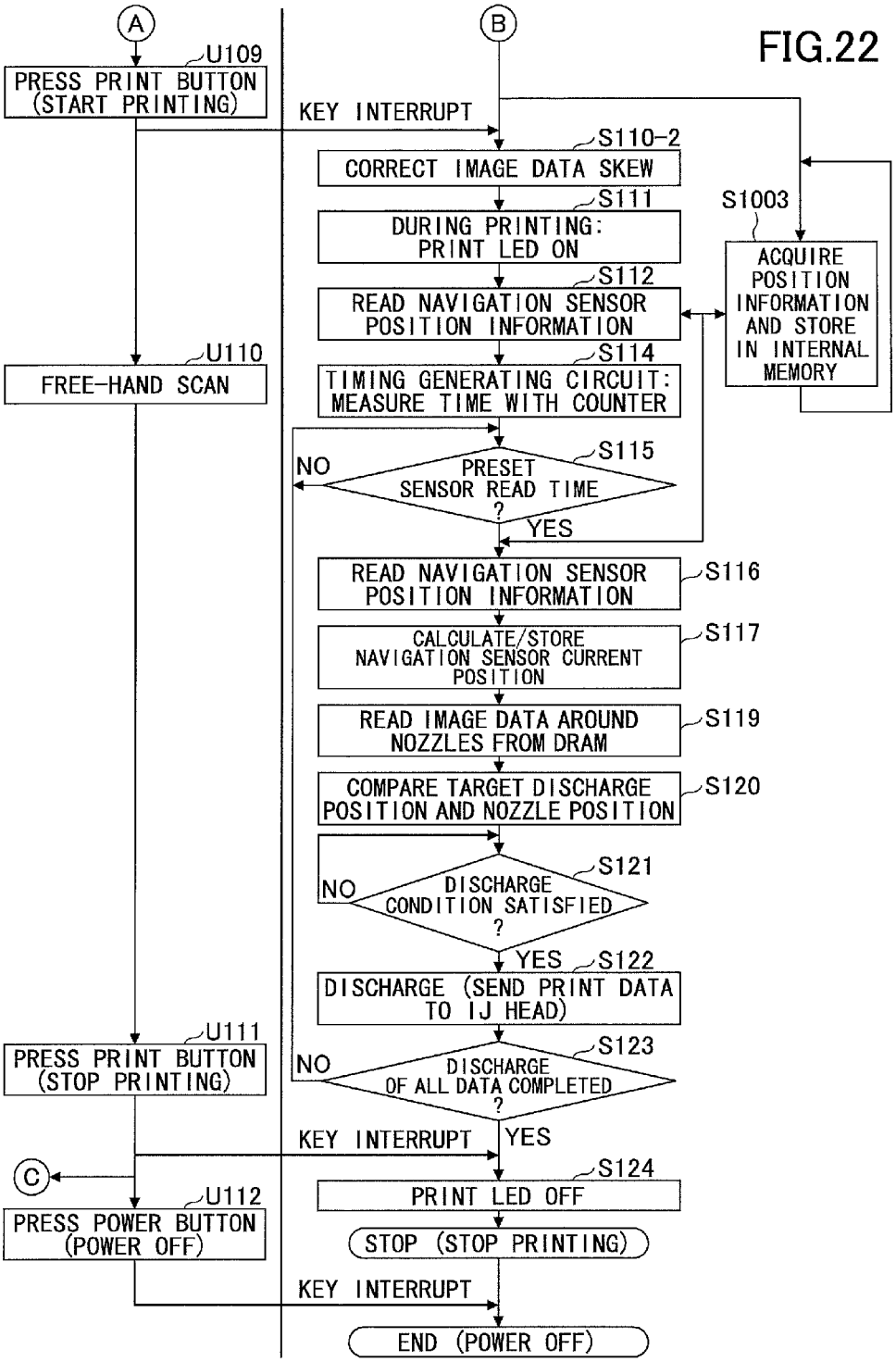
FIG.22
A
B
U109
PRESS PRINT BUTTON (START PRINTING)
KEY INTERRUPT
S110-2
CORRECT IMAGE DATA SKEW
S111
DURING PRINTING: PRINT LED ON
S1003
ACQUIRE POSITION INFORMATION AND STORE IN INTERNAL MEMORY
S112
READ NAVIGATION SENSOR POSITION INFORMATION
U110
FREE-HAND SCAN
S114
TIMING GENERATING CIRCUIT: MEASURE TIME WITH COUNTER
S115
NO
PRESET SENSOR READ TIME ?
YES
S116
READ NAVIGATION SENSOR POSITION INFORMATION
S117
CALCULATE/STORE NAVIGATION SENSOR CURRENT POSITION
S119
READ IMAGE DATA AROUND NOZZLES FROM DRAM
S120
COMPARE TARGET DISCHARGE POSITION AND NOZZLE POSITION
S121
NO
DISCHARGE CONDITION SATISFIED ?
YES
S122
DISCHARGE (SEND PRINT DATA TO IJ HEAD)
U111
PRESS PRINT BUTTON (STOP PRINTING)
S123
NO
DISCHARGE OF ALL DATA COMPLETED ?
KEY INTERRUPT
YES
C
S124
PRINT LED OFF
U112
PRESS POWER BUTTON (POWER OFF)
STOP (STOP PRINTING)
KEY INTERRUPT
END (POWER OFF)

IMAGE FORMING APPARATUS AND IMAGE FORMING METHOD

CROSS-REFERENCE TO RELATED APPLICATIONS

This patent application is based on and claims priority to Japanese Patent Application No. 2015-102108, filed on May 19, 2015, the entire content of which is hereby incorporated by reference.

BACKGROUND OF THE INVENTION

1. Field of the Invention

The present invention relates to an image forming apparatus and an image forming method.

2. Description of the Related Art

Printers that convey paper and form an image by discharging ink at the time the print medium reaches an image forming position are known. On the other hand, small printers (hereinafter referred to as "handheld printer(s)") that have no paper conveying system are being developed. Such handheld printers are held by a user and are manually moved on a print medium, such as paper, to form an image on the print medium.

However, such handheld printers are prone to rotate with respect to the print medium. In this respect, for example, PCT Japanese Translation Patent Publication No. 2010-522650 describes a technique for detecting rotation of a handheld printer based on a difference in displacement measurements obtained by two position sensors included in the handheld printer.

Although the above-described technique enables rotation correction (skew correction) while the handheld printer is forming an image, this technique may not be suited for performing skew correction when the handheld printer is at an initial position.

SUMMARY OF THE INVENTION

According to an embodiment of the present invention, an image forming apparatus is provided that includes a displacement detecting unit configured to detect a displacement of the image forming apparatus with respect to a first direction and a second direction when the image forming apparatus moves away from a first position, the first direction and the second direction being parallel to a surface of a print medium. The image forming apparatus also includes a skew information acquiring unit configured to acquire skew information of the image forming apparatus at the first position based on the displacement of the image forming apparatus with respect to the first direction and the second direction, and a skew controlling unit configured to control skewing of an image to be formed on the print medium based on the skew information of the image forming apparatus, the skewing of the image occurring when the image forming apparatus is skewed with respect to the print medium at the first position upon starting image formation. The image forming apparatus further includes an image forming unit configured to form the skewing-controlled image that has been subjected to the skewing control by the skew controlling unit on the print medium.

BRIEF DESCRIPTION OF THE DRAWINGS

FIG. 16 is a flowchart showing an example operation procedure of the handheld printer from activation of the handheld printer to the end of image formation;

FIG. 17 is a flowchart showing the operation procedure of the handheld printer from activation of the handheld printer to end of image formation, continued from FIG. 16;

FIG. 21 is a flowchart showing another example operation procedure of the handheld printer from activation of the handheld printer to the end of image formation; and FIG. 22 is a flowchart showing another example operation procedure of the handheld printer from activation of the handheld printer to the end of image formation, continued from FIG. 21.

DESCRIPTION OF EMBODIMENTS

In the following, embodiments of the present invention are described with reference to the accompanying drawings.

Figure 1B:
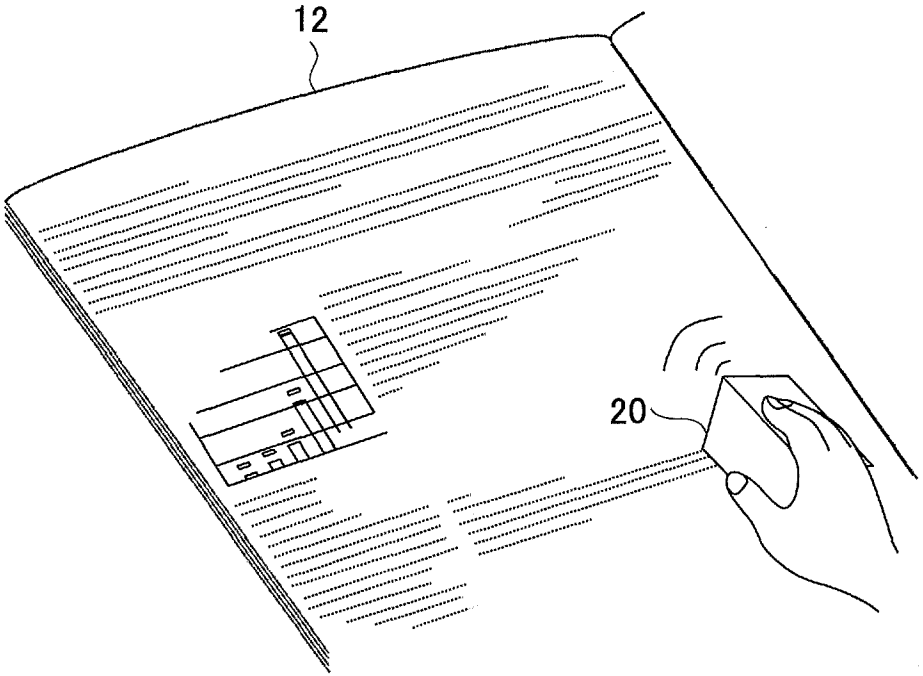
FIGS. 1A and 1B are diagrams schematically showing an example image forming operation using a handheld printer.
Figure 1A:
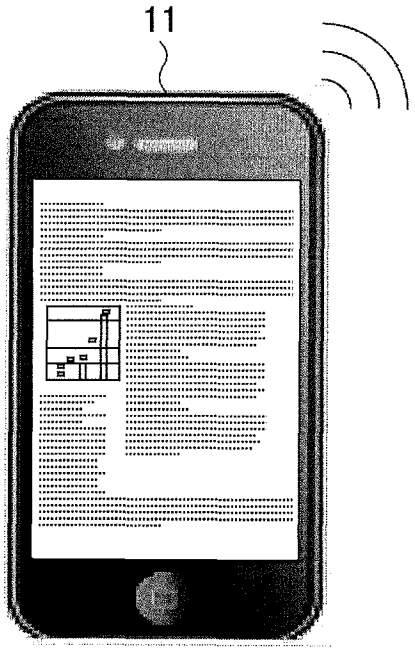

FIGS. 1A and 1B are diagrams schematically showing an example image forming operation performed using a handheld printer 20. The handheld printer 20 may receive image data from an image data output device 11, such as a smartphone or a PC (Personal Computer), for example. A user holds the handheld printer 20 and manually moves the handheld printer 20, free-hand, on a print medium 12, such as standard-size paper, a notebook, and the like. The handheld printer 20 includes a position detecting mechanism such that when the handheld printer 20 moves to a target discharge position, the handheld printer 20 is capable of discharging ink in a suitable color onto the target discharge position. A location on the print medium where ink has already been discharged is masked (because the location is no longer subject to an ink discharging process), and in this way, the user may form an image on the print medium 12 by moving the handheld printer 20 in any given direction on the print medium 12.

However, when the user manually moves the handheld printer 20, free-hand, on the print medium 12 to form an image, the handheld printer 20 may rotate with respect to the print medium 12. When the handheld printer 20 rotates with respect to the print medium 12, the nozzle alignment direction of a plurality of nozzles arranged in the handheld printer 20 also rotates with respect to the print medium 12 to thereby cause skewing of the image with respect to the print medium.

According to an aspect of the present invention, an image forming apparatus that is capable of controlling skewing of an image with respect to a print medium is provided.

Figure 2A:
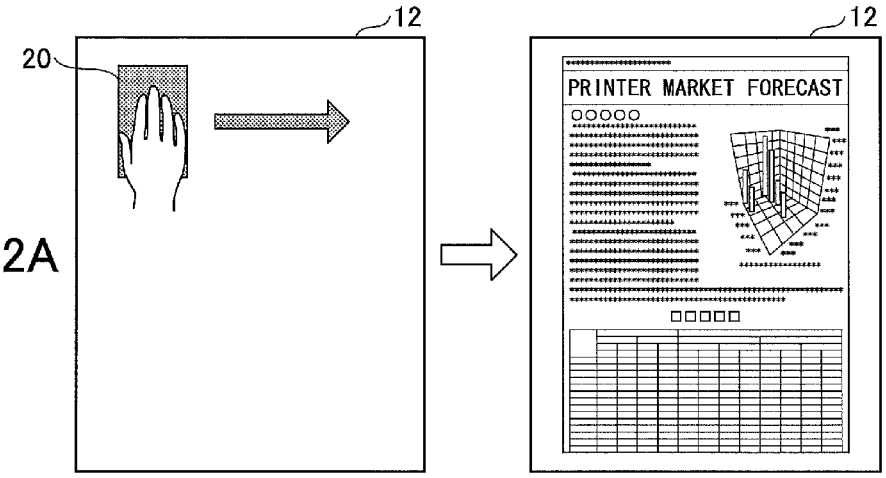
FIGS. 2A-2C are diagrams showing examples of images formed when the handheld printer is skewed with respect to a print medium.
Figure 2B:
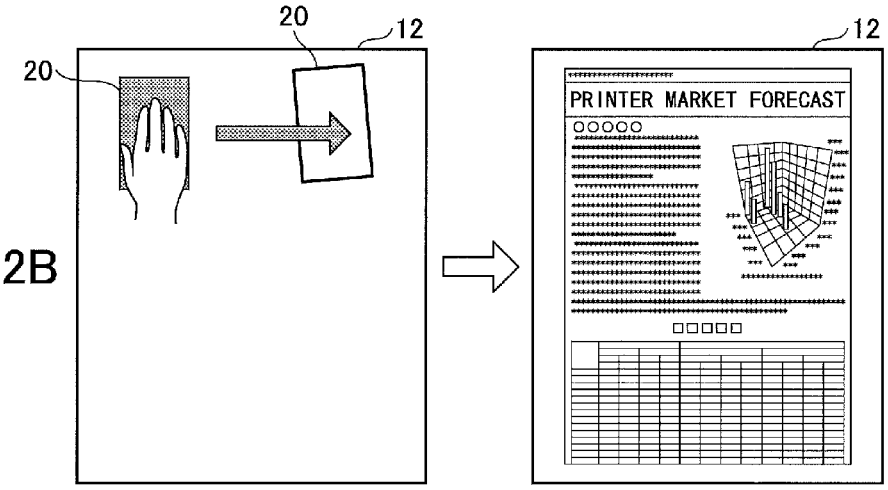
Figure 2C:
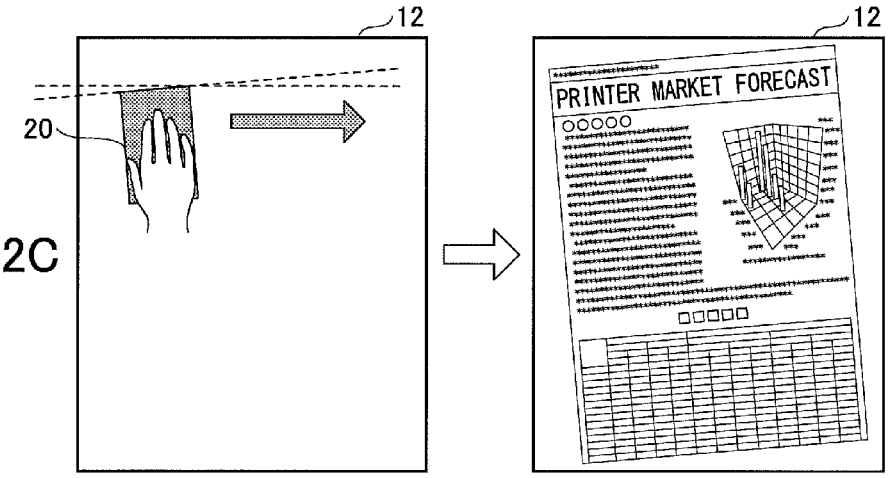

FIGS. 2A-2C are diagrams showing examples of images formed when the handheld printer 20 is skewed with respect to the print medium 12. In FIG. 2A, the handheld printer 20 is not skewed with respect to the print medium 12. Thus, the image formed by the handheld printer 20 is not skewed with respect to the print medium 12.

Also, as shown in FIG. 2B, even when the handheld printer 20 is rotated (skewed) with respect to the print medium 12 during image formation, such rotation (skew) may be corrected by detecting the rotation of the handheld printer 20 during image formation. Thus, in FIG. 2B, the image formed by the handheld printer 20 is not skewed with respect to the print medium 12.

On the other hand, as shown in FIG. 2C, when the handheld printer 20 is skewed with respect to the print medium 12 at an initial position where the handheld printer 20 starts image formation (printing), the image formed on the print medium 12 may be skewed with respect to the print medium 12. That is, in a case where the orientation of a recording head of the handheld printer 20 at the initial position is unconditionally presumed to be 0 degrees even though the handheld printer 20 is skewed at the initial position, and an image is formed based on position information of the handheld printer 20 detected during image formation, the resulting image will be skewed with respect to the print medium 12.

Note that a "rotation" or a "skew" of the handheld printer 20 with respect to the print medium 12 may refer to an instance where a vertical direction of the print medium 12 and a vertical direction (e.g., nozzle alignment direction) of the handheld printer 20 deviate from one another while a surface of the print medium 12 and a nozzle surface of the handheld printer 20 remain parallel to each other, for example.

According to an aspect of the present invention, an image forming apparatus and an image forming method are provided that can control such skewing of an image with respect to a print medium.

First Embodiment

In the following, a first embodiment of the present invention is described.

<Initial Position Skew Correction Method>

According to the present embodiment, a user performs a calibration process before performing an image forming process to correct a skew of the handheld printer 20 at an initial position (image formation start position).

Figure 3A:
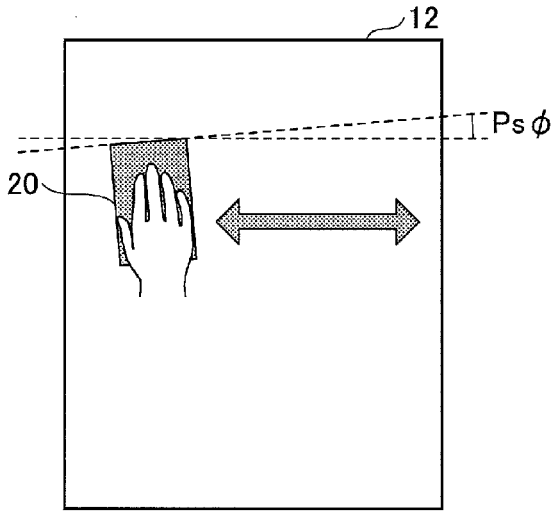
FIGS. 3A-3C are diagrams showing an example skew correction method for correcting a skew of the handheld printer with respect to the print medium at an initial position.
Figure 3B:
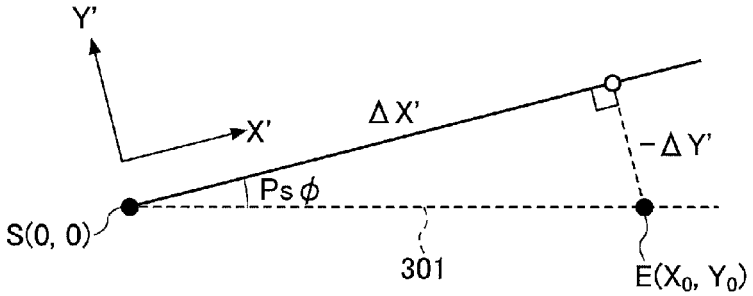
Figure 3C:
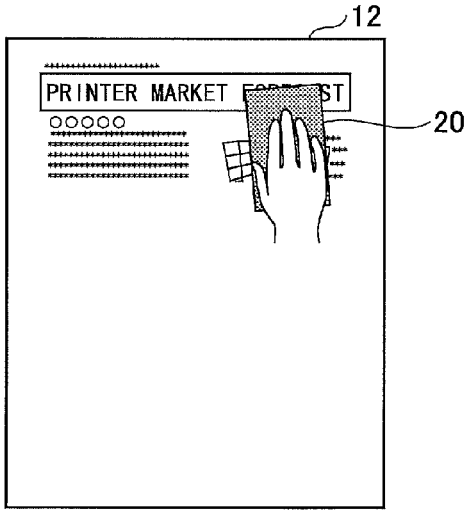

FIGS. 3A-3C are diagrams showing an example skew correction method for correcting the skew of the handheld printer 20 with respect to the print medium 12 at the initial position. FIG. 3A schematically shows a calibration process performed by the user. The user moves the handheld printer 20 substantially horizontally with respect to the print medium 12. At this time, the handheld printer 20 may be skewed with respect to the print medium 12. Note that in a case where the handheld printer 20 is not skewed, the calibration process does not have to be performed but may be optionally performed. In FIG. 3A, the handheld printer 20 is rotated counterclockwise by a skew Psφ at the initial position.

FIG. 3B is a diagram showing the relationship between a trajectory 301 of the handheld printer 20 in the horizontal direction and the skew Psφ of the handheld printer 20. The handheld printer 20 defines a straight line connecting a pre-scan start point S and a pre-scan end point E (turn-around point described below) as the horizontal direction. The handheld printer 20 detects the displacement of the hand held printer 20 when it is moved from the start point S to the end point E. Note that for convenience of explanation, coordinates of the start point S are set to (0, 0), and coordinates of the end point E are set to $(X_0, Y_0)$. The coordinates (0, 0) and $(X_0, Y_0)$ represent points on an X-Y coordinate system having X and Y axes extending horizontally and vertically with respect to the print medium 12 (print medium coordinates described below).

On the other hand, in detecting the displacement from the pre-scan start point S to the pre-scan end point E, the handheld printer 20 detects the displacement based on an X'-Y' coordinate system having the X' and Y' axes extending horizontally and vertically with respect to the nozzle alignment direction of nozzles arranged in the recording head of the handheld printer 20. That is, the handheld printer 20 detects a displacement LX' in the X'-axis direction (displacement in a first direction) and a displacement −ΔY' in the Y'-axis direction (displacement in a second direction) when the handheld printer 20 is moved from the pre-scan start point S to the pre-scan end point E. The skew Psφ of the handheld printer 20 may be obtained based on the above displacements ΔX' and −ΔY'. Note that in FIG. 3B, the skew Psφ at the pre-scan end point E is the same as the skew Psφ of the handheld printer 20 at the initial position (pre-scan start point S).

The handheld printer 20 according to the present embodiment corrects target discharge positions for discharging ink (for forming pixels) based on the skew Psφ at the initial position. By correcting the target discharge positions based on the skew Psφ, even when the recording head of the handheld printer 20 is skewed with respect to the print medium 12 at the initial position, skewing of an image formed on the print medium 12 may be controlled/prevented as shown in FIG. 3C. Also, even when the handheld printer 20 is not skewed at the initial position, a position sensor for detecting the position of the handheld printer 20 may not be installed in the appropriate position (i.e., the position sensor may be skewed). According to the present embodiment, skewing of an image formed on the print medium 12 may be controlled/prevented in such a case as well.

<Configuration>

Figure 4:
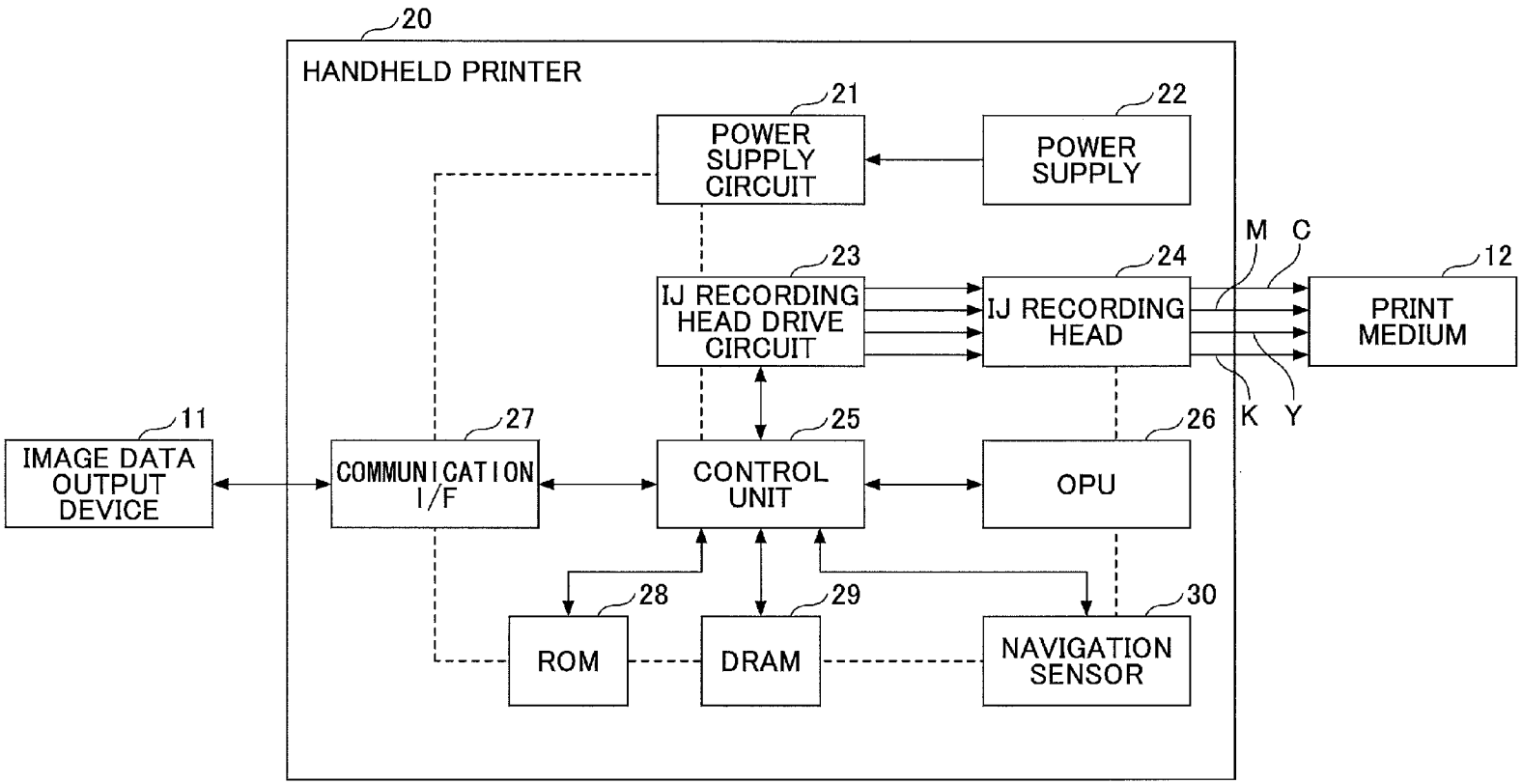
FIG. 4 is a block diagram showing an example hardware configuration of the handheld printer.

FIG. 4 is a block diagram showing an example hardware configuration of the handheld printer 20 according to the present embodiment. The handheld printer 20 is an example of an image forming apparatus that forms an image on the print medium 12. The handheld printer 20 includes a control unit 25 that controls the overall operations of the handheld printer 20. Further, the handheld printer 20 includes a communication I/F (interface) 27, an IJ (inkjet) recording head drive circuit 23, an OPU (operation panel unit) 26, a ROM (read-only memory) 28, a DRAM (dynamic random access memory) 29, and a navigation sensor 30 that are electrically connected to the control unit 25. Also, the handheld printer 20 is electrically driven, and therefore includes a power supply 22 and a power supply circuit 21. The power generated by the power supply circuit 21 is supplied to the communication I/F 27, the IJ recording head drive circuit 23, the OPU 26, the ROM 28, the DRAM 29, the IJ recording head 24, the control unit 25, and the navigation sensor 30.

A battery may be used as the power supply 22. Also, in some embodiments, a solar cell, a fuel cell, a commercial power source (AC power supply), or the like may be used as the power supply 22. The power supply circuit 21 distributes the power provided by the power supply 22 to the respective units of the handheld printer 20. Also, the power supply circuit 21 adjusts the voltage of the power supplied by the power supply 22 to voltages suitable for the respective units of the handheld printer 20. Further, in a case where the power supply 22 is a rechargeable battery, the power supply circuit 21 may detect an AC power supply connection and connect the power supply 21 to a charging circuit to charge the power supply 22.

The communication I/F 27 receives image data from the image data output device 11, which may be a smartphone or a PC (Personal Computer), for example. The communication I/F 27 may be a communication device compatible with a communication standard, such as wireless LAN communication, Bluetooth (registered trademark), NFC (Near Field Communication), infrared communication, 3G, LTE (Long Term Evolution), etc. Also, the communication I/F 27 may be a communication device compatible with wired communication using a wired LAN or a USB cable, for example.

The ROM 28 stores firmware for performing hardware control of the handheld printer 20, drive waveform data for driving the IJ recording head 24 (e.g., data prescribing a voltage change for discharging liquid droplets), initial setting data of the handheld printer 20, and the like.

The DRAM 29 may be used to store the image data received by the communication I/F 27 or firmware loaded from the ROM 28, for example. That is, the DRAM 29 is used as a working memory for enabling a CPU 31 to execute firmware and the like.

The navigation sensor 30 is a sensor for detecting the position of the handheld printer 20. The navigation sensors 30 may include a light source, such as a light emitting diode (LED) or laser, and an imaging sensor for imaging the print medium 12. When the handheld printer 20 is scanned across the print medium 12, fine edges on the print medium 12 may be successively detected (imaged) by the navigation sensor 30, and displacement of the handheld printer 20 may be obtained by analyzing the distance between the detected edges. Note that at least two navigation sensors 30 are installed in at least two different locations of the handheld printer 20. The navigation sensors 30 may be referred to as navigation sensor $S_0$ and navigation sensor $S_1$ when one is to be distinguished from the other. Also, in some embodiments, a multi-axis acceleration sensor or a gyro sensor may be used as the navigation sensors 30, and the position of the handheld printer 20 may be detected using such an acceleration sensor or a gyro sensor, for example.

The OPU 26 may include LEDs for indicating the status of the handheld printer 20, a switch for the user to input an instruction to perform image formation, and the like. Note, however, that elements of the OPU 26 are not limited to the above. For example, the OPU 26 may include a liquid crystal display and/or a touch panel. It may also include an audio input function, for example.

The IJ recording head drive circuit 23 generates a drive waveform (voltage) for driving the IJ recording head 24 based on drive waveform data. For example, the IJ recording head drive circuit 23 may generate a drive waveform according to the ink droplet size of ink to be discharged.

The IJ recording head 24 is a recording head from which ink is discharged. Note that the IJ recording head 24 shown in FIG. 4 is capable of discharging ink in four different colors; i.e., C (cyan), M (magenta), Y (yellow), and K (black). However, in other embodiments, the IJ recording head 24 may be configured to discharge ink in a single color or five or more colors, for example. The IJ recording head 24 includes a plurality of nozzles arranged into at least one array for discharging ink in each color. Note that the ink discharge method implemented by the IJ recording head 24 may be the piezoelectric method, the thermal method, or some other suitable method.

The control unit 25 performs operations, such as detecting the position of each nozzle of the IJ recording head 24 based on the displacement detected by the navigation sensor 30, determining an image to be formed based on the detected nozzle position, determining whether to discharge ink from the nozzles, and the like. Note that operations of the control unit 25 are described in detail below.

Figure 5:
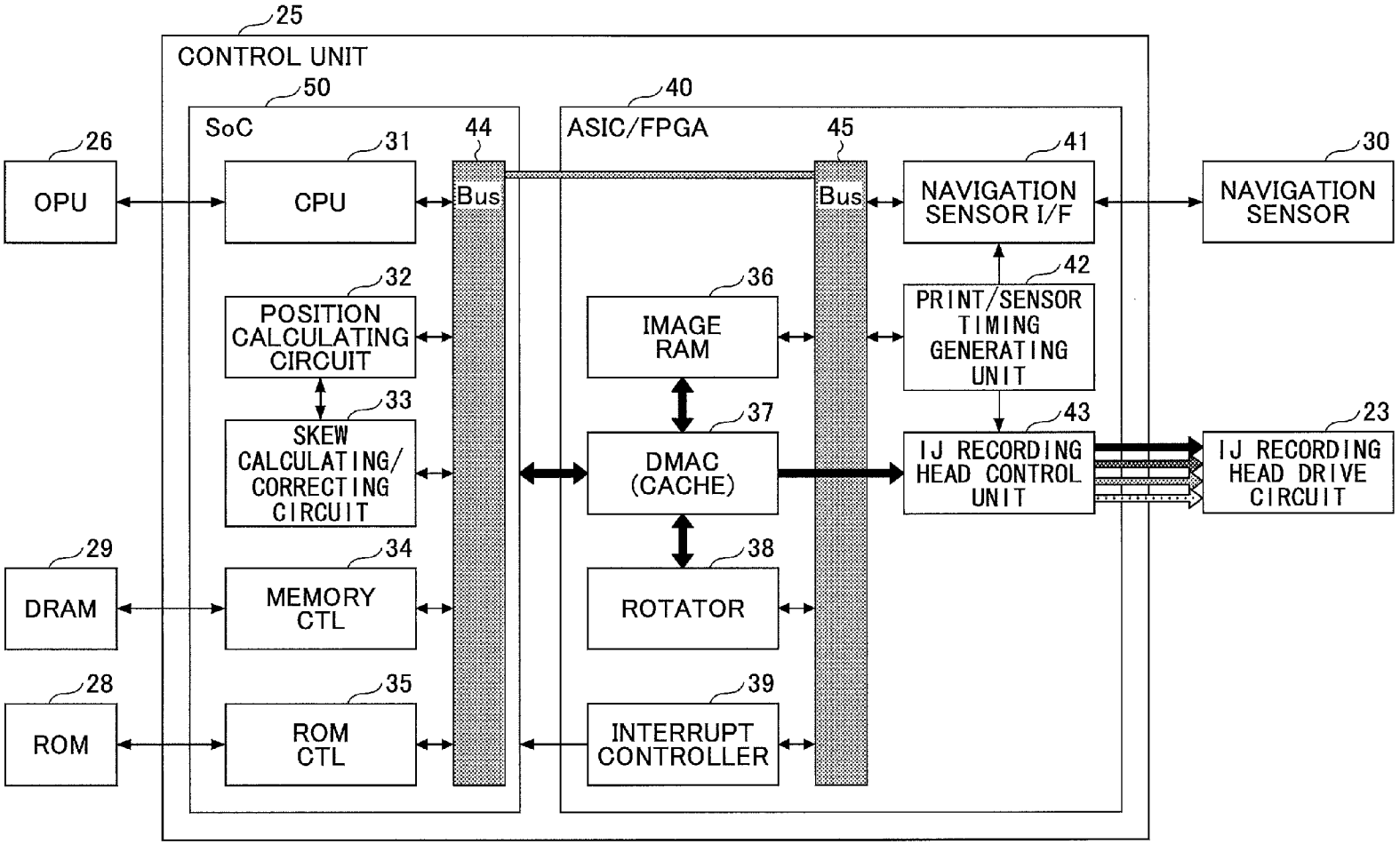
FIG. 5 is a block diagram showing an example configuration of a control unit.

FIG. 5 is a block diagram showing an example configuration of the control unit 25. The control unit 25 includes a SoC (System on Chip) 50 and an ASIC (Application Specific Integrated Circuit)/FPGA (Field Programmable Gate Array) 40. The SoC 50 and the ASIC/FPGA 40 communicate via buses 44 and 45. Note that the ASIC/FPGA 40 may be an integrated circuit designed to have a specific configuration for a specific purpose either using ASIC or FPGA technology. Also, some other suitable configuration technology may be used instead of the ASIC/FPGA 40. Also, in some embodiments, the SoC 50 and the ASIC/FPGA 40 may be configured by one chip or one substrate rather than separate chips. In other embodiments, the SoC 50 and the ASIC/FPGA 40 may be configured by three or more chips/substrates.

The SoC 50 includes functions of a CPU 31, a position calculating circuit 32, a skew calculating/correcting circuit 33, a memory CTL (controller) 34, and a ROM CTL 25 that are connected via the bus 44. Note, however, that elements of the SoC 50 are not limited to the above elements.

The ASIC/FPGA 40 includes an image RAM 36, a DMAC (Direct Memory Access Controller) 37, a rotator 38, an interrupt controller 39, a navigation sensor I/F 41, a print/sensor timing generating unit 42, and an IJ recording head control unit 43 that are connected via the bus 45. Note, however, that the elements of the ASIC/FPGA 40 are not limited to the above elements.

The CPU 31 executes firmware loaded from the ROM 28 into the DRAM 29 to control operations of the position calculating circuit 32, the skew calculating/correcting circuit 33, the memory CTL 34, and the ROM CTL 35 of the SoC 50. The CPU 31 also controls operations of the Image RAM 36, the DMAC 37, the rotator 38, the interrupt controller 39, the navigation sensor I/F 41, the print/sensor timing generating unit 42, and the IJ recording head control unit 43 of the ASIC/FPGA 40.

The position calculating circuit 32 calculates position information (coordinate information) of the handheld printer 20 based on the displacement detected by the navigation sensor 30 with respect to each sampling period. Note that, strictly speaking, the position information of the handheld printer 20 refers to the positions of the nozzles. However, once the position of the navigation sensor 30 is determined, the nozzle positions can be calculated based on the detected position of the navigation sensor 30. In following descriptions of the present embodiment, unless otherwise specified, it is assumed that the position calculating circuit 32 uses the position information of the navigation sensor $S_0$ (out of the navigation sensors $S_0$ and $S_1$) as the position of the navigation sensor 30 to calculate the position information of the handheld printer 20. Also, the position calculating circuit 32 calculates the target discharge position.

The position information of the navigation sensor 30 may be calculated based on a predetermined origin, such as the initial position of the handheld printer 20 upon staring image formation as described below, for example. The position calculating circuit 32 estimates a moving speed and a moving direction based on the difference between a previous position and a most recent position to predict the position of the navigation sensor 30 at the next calculation timing, for example. In this way, ink may be discharged with little delay from the scanning operation of the user, for example.

The skew calculating/correcting circuit 33 calculates the skew Psφ of the handheld printer 20 with respect to the print medium 12 at the initial position. Also, based on the calculated skew Psφ, the skew calculating/correcting circuit 33 corrects the target discharge position calculated by the position calculating circuit 32. Note that the skew calculating/correcting circuit 33 is described in detail below with reference to FIG. 6. The memory CTL 34 is an interface with the DRAM 29. The memory CTL 34 may request data, such as firmware or image data, from the DRAM 29, and send the acquired firmware to the CPU 31, or send the acquired image data to the ASIC/FPGA 40, for example.

The ROM CTL 35 is an interface with the ROM 28. The ROM CTL 35 requests data from the ROM 28, and sends the acquired data to the CPU 31 or the ASIC/FPGA 40.

The DMAC 37 acquires image data of an image to be formed around the position of the nozzles of the IJ recording head 24 from the DRAM 27, via the memory CTL 34, based on the position information calculated by the position calculating circuit 32, for example. That is, the DMAC 37 acquires image data of an image (e.g., pixels) to be formed around a position of the print medium 12 at which the handheld printer 20 is located.

The rotator 38 rotates the image data acquired by the DMAC 37 according to the recording head that is to discharge ink and the nozzle position of the nozzles within the recording head. The DMAC 37 then outputs the rotated image data to the IJ recording head control unit 43. To rotate the image data, for example, the rotator 38 may acquire a rotation angle θ that is obtained by the position calculating circuit 32 while calculating the position of the handheld printer 20 and rotate the image data based on the acquired rotation angle θ.

The image RAM 36 temporarily stores the image data acquired by the DMAC 37. That is, the image RAM 36 acts as an image buffer that temporarily stores a certain amount of image data and enables the image data to be read out according to the detected position of the handheld printer 20.

The IJ recording head control unit 43 implements a dithering process or the like to convert image data (bitmap data) into a set of dots (dot data) representing an image by dot size and density, for example. In this way, the image data may be converted into data representing a dot discharge position and a dot size. The IJ recording head control unit 43 outputs a control signal according to the dot size of the image to the IJ recording head drive circuit 23. The IJ recording head drive circuit 23 generates a drive waveform (voltage) based on drive waveform data corresponding to such a control signal.

The navigation sensor I/F 41 communicates with the navigation sensor 30 to receive information including displacements ΔX' and ΔY' (described below) from the navigation sensors 30, and stores the received values in an internal register.

The print/sensor timing generating unit 42 notifies the navigation sensor I/F 41 of the timing for reading (acquiring) information from the navigation sensor 30, and notifies the IJ recording head control unit 43 of the timing for driving the IJ recording head 24. The IJ recording head control unit 43 determines whether ink has to be discharged from the nozzles. If there is a nozzle located at/close to a target discharge position on which ink has to be discharged, the IJ recording head control unit 43 discharges ink from the nozzle, and if not, the IJ recording head control unit 43 does not discharge any ink.

The interrupt controller 39 detects when communication between the navigation sensor I/F 41 and the navigation sensor 30 has ended, and outputs an interrupt signal to notify the SoC 50. By receiving such an interrupt signal, the CPU 31 may acquire the information ΔX' and ΔY' stored in the internal register of the navigation sensor I/F 41. The interrupt controller 39 may also have status notification functions for notifying an error and the like.

<<Skew Calculating/Correcting Circuit>>

Figure 6:
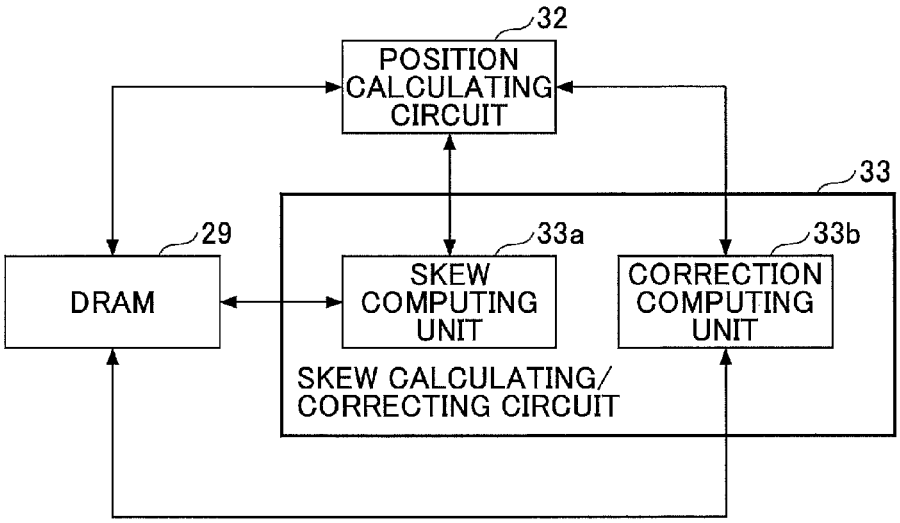
FIG. 6 is a block diagram showing an example configuration of a skew calculating/correcting circuit.

FIG. 6 is a block diagram showing an example configuration of the skew calculating/correcting circuit 33. The skew calculating/correcting circuit 33 includes a skew computing unit 33*a* and a correction computing unit 33*b*. The skew calculating unit 33*a* calculates the skew Psφ based on the position information calculated by the position calculating circuit 32 during the calibration process and stores the calculated skew Psφ in the DRAM 29, for example.

The correction calculating unit 33*b* corrects the target discharge position based on the skew Psφ stored in the DRAM 29, for example. Also, in some embodiments, the correction calculating unit 33*b* may be configured to correct the target discharge position after correcting the initial position of the handheld printer 20 based on the skew Psφ, for example.

Note that although the skew calculating/correcting circuit 33 is illustrated in FIGS. 5 and 6 as a circuit configured by hardware, the functions of the skew calculating/correcting circuit 33 may also be implemented by software. In this case, the skew calculating/correcting circuit 33 may be omitted, and the functions of the skew calculating/correcting circuit 33 may be implemented by the CPU 31 executing a relevant program such as firmware, for example. Note, also, that functions of the position calculating circuit 32 may similarly be implemented by software.

<Target Discharge Position>

Figure 7:
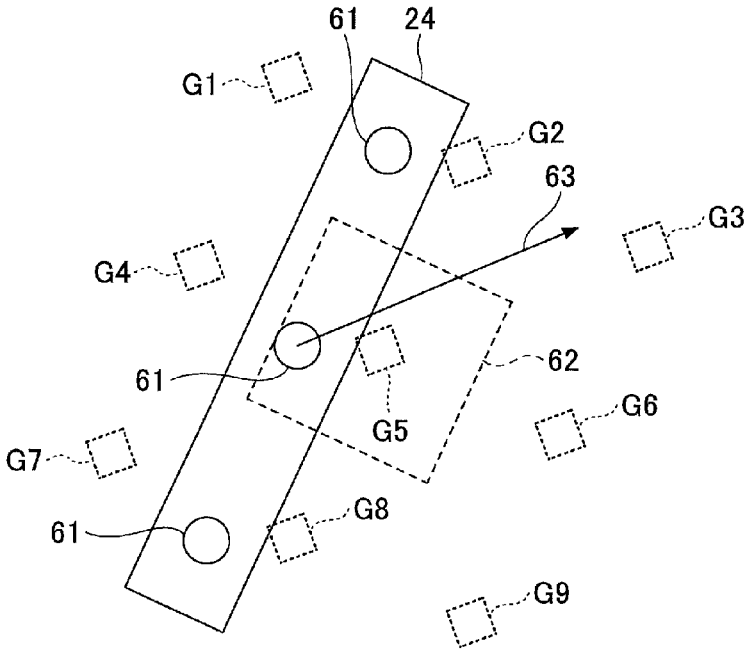
FIG. 7 is a diagram showing a relationship between a target discharge position and a nozzle position.

In the following, the target discharge position is described with reference to FIG. 7. FIG. 7 is a diagram showing an example relationship between target discharge positions and the positions of nozzles 61. FIG. 7 shows target discharge positions G1-G9 in a case where the IJ recording head 24 is skewed with respect to the print medium 12 at the initial position. The target discharge positions G1-G9 are target positions onto which the handheld printer 20 is to discharge ink from the nozzles 61 (to form pixels). The target discharge positions G1-G9 can be obtained based on the initial position of the handheld printer 20 and the resolution (Xdpi, Ydpi) of the handheld printer 20 in the X-axis/Y-axis directions.

For example, if the resolution is 300 dpi, the target discharge position may be set up at approximately 0.084-mm intervals along the longitudinal direction of the IJ recording head 24 and along a direction perpendicular to the longitudinal direction. If one or more of the target positions G1-G9 corresponds to where pixels are to be formed, the handheld printer 20 discharges ink from the relevant nozzles 61.

However, in practice, it is difficult to determine the exact timing at which the position of the nozzle 61 and the target discharge position completely coincide, and as such, an allowable error range 62 is set up with respect to the target position of the handheld printer 20 and the current position of the nozzle 61. Thus, if it is determined that the current position of the nozzle 61 is within the allowable error range 62 with respect to the target discharge position, ink is discharged from the nozzle 61. Note that providing such an allowable error range and determining whether the position of the nozzle is within the allowable error range with respect to the target position is hereinafter referred to as "nozzle discharge determination".

Also, as indicated by an arrow 63, the handheld printer 20 monitors the moving direction and the speed of the nozzle 61 to predict positions of the nozzles 61 at the next sampling period. In this way, the handheld printer 20 may be able to make preparations for discharging ink from the relevant nozzles 61 by comparing the predicted positions of the nozzles 61 and the target discharge positions in view of the allowable error range 62. Note that in the following descriptions of the present embodiment, unless otherwise specified, distinctions are not particularly made between the most recently calculated position information of the nozzles 16 and the predicted position information of the nozzles 61, and they are both referred to as "current position".

As shown in FIG. 7, when the IJ recording head 24 is skewed with respect to the print medium 12 at the initial position, the target discharge positions G1-G9 set up based on the initial position will also be skewed such that the image formed on the print medium 12 will be skewed.

In the present embodiment, as described below with reference to FIG. 13, the target discharge positions are corrected based on the skew of the handheld printer 20 at the initial position. In this way, skewing of the image to be formed may be controlled.

<External View of Handheld Printer>

Figure 8:
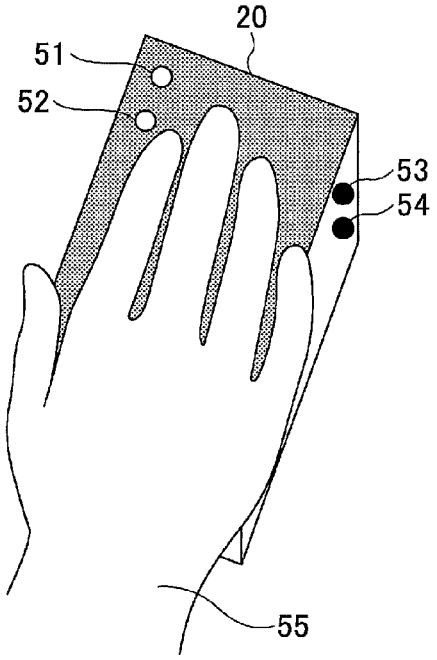
FIG. 8 is a schematic external view of the handheld printer.

FIG. 8 shows an example schematic external view of the handheld printer 20 according to the present embodiment. The handheld printer 20 of FIG. 8 is in a size that allows a user to hold the handheld printer 21 by the hand 55. However, the handheld printer 20 may be larger (i.e., a larger IJ recording head 24 may be mounted therein) if the handheld printer 20 includes a grip part, such as a handle, for example. Also, note that although the handheld printer 20 shown in FIG. 8 has a cuboid shape, the external shape of the handheld printer 20 is not limited thereto.

The handheld printer 20 includes an operating unit with several LEDs and buttons. Specifically, the handheld printer 20 includes a power button 53 to be pressed by the user when turning on/off the power supply 22 of the handheld printer 20. The handheld printer 20 also includes a print button 54 to be pressed by the user to instruct the handheld printer 20 to perform a pre-scan operation or an image forming operation.

The handheld printer 20 also includes a power LED 51 for notifying the user of the power status of the handheld printer 20. For example, by controlling the lighting status (on/off/blinking) and the light color of the power LED 51, the power LED may indicate to the user that the power supply 22 is turned on and the handheld printer 20 can be used. The handheld printer 20 also includes a print LED 52 for notifying the user of the print status of the handheld printer 20. For example, by controlling the lighting status and the light color of the print LED 52, the print LED 52 may indicate to the user that the handheld printer 20 is currently performing an image forming (printing) operation or a pre-scan operation.

<<Status Notification by LED>>

The LEDs of FIG. 8 can represent various statuses of the handheld printer 20 by adjusting their lighting status.

TABLE 1

| STATUS 1 | STATUS 2 | POWER LED | PRINT LED |
|---|---|---|---|
| POWER OFF | — | OFF | OFF |
| NORMAL STANDBY | STANDBY | ON | OFF |
| | TRANS-MITTING DATA | ON | BLINKING (AT 1-SECOND INTERVALS) |
| PRE-SCANNING | — | ON | BLINKING (AT 0.5-SECOND INTERVALS) |
| PRINT STANDBY | — | BLINKING (AT 1-SECOND INTERVALS) | OFF |
| PRINTING | — | ON | ON |
| ABNORMAL | WARNING | ON | BLINKING (AT 1-SECOND INTERVALS) |
| | STOP PRINTING | BLINKING (AT 2-SECOND INTERVALS) | BLINKING (AT 2-SECOND INTERVALS) |

The above Table 1 is an example of a LED status table indicating the correlation between the LED lighting status and the status of the handheld printer 20. In the LED status table of Table 1, "status 1" and "status 2" represent various statuses of the handheld printer 20, and these statuses are associated with corresponding lighting statuses of the power LED 51 and the print LED 52.

Possible lighting statuses of the power supply LED 51 and the print LED 52 include on, off, and blinking. Further, the LEDs may be blinking at various blinking time intervals according to the status of the handheld printer 20.

For example, when the handheld printer 20 is in normal standby mode (status 1), the power supply LED 51 is turned on. Further, when the handheld printer 20 is simply waiting ("standby" mode under status 2), the printing LED 52 is turned off. On the other hand, when the handheld printer 20 is transmitting data (status 2), the print LED 52 is controlled to blink at 1-second intervals.

In this way, various statuses of the handheld printer 20 may be represented by the different combinations of the lighting statuses (on/off/blinking at different time intervals) of the two LEDs. Also, in some embodiments, the various statuses of the handheld printer 20 may also be represented using various light colors, for example.

<Nozzle Position in IJ Recording Head>

In the following, the positions of the nozzles 61 within the IJ recording head 24 are described with reference to FIGS.

Figure 9A:
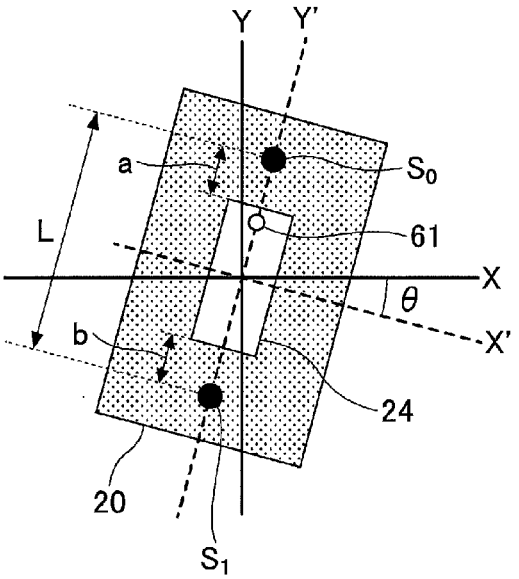
FIGS. 9A and 9B are plan views of the handheld printer.
Figure 9B:
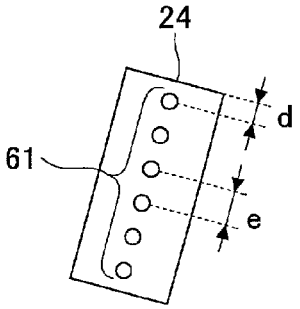

9A and 9B. FIG. 9A shows an example plan view of the handheld printer 20. FIG. 9B shows an example plan view of the IJ recording head 24. Note that the surface plane represented by FIGS. 9A and 9B corresponds to a plane facing the print medium 12.

The handheld printer 20 according to the present embodiment includes two or more navigation sensors 30 (e.g., navigation sensors $S_0$ and $S_1$). By arranging at least two navigation sensors 30 in the handheld printer 20, rotation of the handheld printer 20 during image formation may be detected. In FIG. 9A, two navigation sensors $S_0$ and $S_1$ that are spaced apart from one another by a certain distance in the alignment direction of the nozzles 61 are provided. In FIG. 9A, the distance between the two navigation sensors $S_0$ and $S_1$ is represented as distance L. Note that as the distance L is preferably arranged to be as long as possible. That is, as the distance L is increased, the minimum detectable rotation angle θ can be reduced such that an error in the detected position of the handheld printer 20 may be reduced.

In FIG. 9A, the respective distances from the navigation sensors 30 (i.e., navigation sensors $S_0$ and $S_1$) to IJ recording head 24 are represented as distance "a" and distance "b". The distance "a" and the distance "b" may be equal. Also, as shown in FIG. 9B, the distance from the edge of the IJ recording head 24 to the first nozzle 61 is represented as distance "d", and the distance between two adjacent nozzles 61 is represented as distance "e". The values of the distances a-e are stored in advance in the ROM 28, for example.

In this way, by calculating the position of the navigation sensors 30, the position calculating circuit 32 may be able to calculate the positions of the nozzles 61 based on the distance "a", the distance "b", the distance "d", and the distance "e".

Note that in the present embodiment, the X-axis corresponds to the horizontal direction of the print medium 12, and the Y-axis corresponds to the vertical direction of the print medium 12. The coordinates on the X-Y coordinate system with the above X-axis and Y-axis is referred to as "print medium coordinates". In contrast, the navigation sensors 30 output position information based on the X'-Y' coordinate system with different axes; i.e., X'-axis and Y'-axis, as shown in FIG. 9A. That is, the Y'-axis corresponds to the alignment direction of the nozzles 16 (direction connecting the two navigation sensors $S_0$ and $S_1$), and the X'-axis corresponds to a direction perpendicular to the Y'-axis. The position calculating circuit 32 then calculates the positions of the nozzles 16 based on the position information output by the navigation sensors 30.

<Position of Handheld Printer with Respect to Print Medium>

In the following, the position of the handheld printer 20 with respect to the print medium 12 is described. In FIG. 9A, the handheld printer 20 is rotated clockwise by a rotation angle θ with respect to the print medium 12. If the handheld printer 20 has not been rotated at all (if θ=0), X=X' and Y=Y'. On the other hand, if the handheld printer 20 has been rotated by a rotation angle θ (θ ≠0), the position information output by the navigation sensors $S_0$ and $S_1$ will not coincide with the actual positions on the print medium 12. Note that in the present embodiment, it is assumed that the skew Psφ and the rotation angle θ in the clockwise direction correspond to positive angles, rightward directions of the X-axis and the X'-axis correspond to positive directions, and upward directions of the Y-axis and the Y'-axis correspond to positive directions.

Figure 10A:
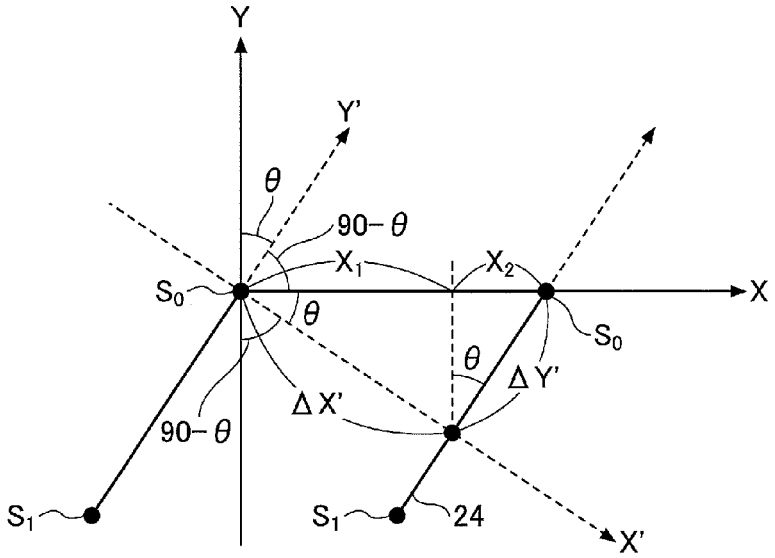
FIGS. 10A and 10B are diagrams showing a relationship between a displacement of the navigation sensor and coordinates on the print medium.
Figure 10B:
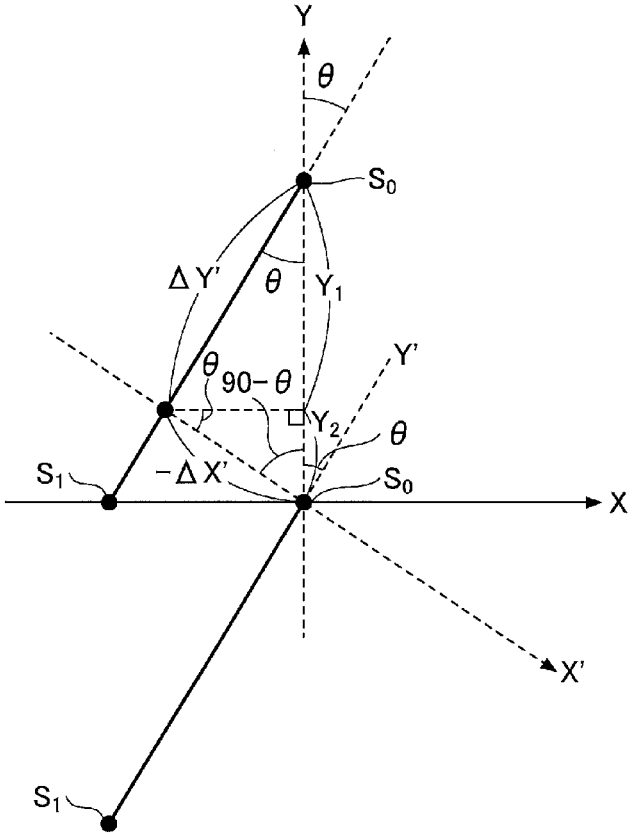

FIGS. 10A and 10B are diagrams showing the correlation between the displacement ΔX' and ΔY' of the navigation sensors 30 and the X and Y print medium coordinates. Referring to FIG. 10A, the displacement ΔX' and the displacement ΔY' output by the navigation sensors 30 have the following relationship with the X and Y print medium coordinates. FIG. 10A shows a correlation between the displacement ΔX' and ΔY' detected by the navigation sensors 30 and the X and Y print medium coordinates in a case where the handheld printer 20 that is rotated by the rotation angle θ is moved only in the X-axis direction while the rotation angle θ remains the same. Note that although only the displacement ΔX' and ΔY' detected by the navigation sensor $S_0$ is shown in FIG. 10A, the outputs of the navigation sensors $S_0$ and $S_1$ will be the same because the navigation sensors $S_0$ and $S_1$ move in parallel with respect to the X-axis direction in the present example. In FIG. 10A, the displacement ΔX' output by the navigation sensors $S_0$ and $S_1$ is reflected in $X_1$, and the displacement ΔY' output by the navigation sensors $S_0$ and $S_1$ is reflected in $X_2$.

FIG. 10B shows a correlation between the displacement ΔX' and ΔY' detected by the navigation sensors 30 and the X and Y print medium coordinates in a case where the handheld printer 20 that is rotated by the rotation angle θ is moved only in the Y-axis direction while the rotation angle θ remains the same. Note that although only the displacement ΔX' and ΔY' detected by the navigation sensor $S_0$ is shown in FIG. 10B, the outputs of the navigation sensors $S_0$ and $S_1$ will be the same because the navigation sensors $S_0$ and $S_1$ move in parallel with respect to the X-axis direction in the present example. In FIG. 10B, the displacement ΔY' output by the navigation sensors $S_0$ and $S_1$ is reflected in $Y_1$, and the displacement −ΔX' output by the navigation sensors $S_0$ and $S_1$ is reflected in $Y_2$.

Accordingly, when the handheld printer 20 is moved in the X-axis direction and the Y-axis direction while the rotation angle θ remains the same, the displacement ΔX' and ΔY' output by the navigation sensors $S_0$ and $S_1$, can be converted into X and Y print medium coordinates based on the formulas (1) and (2) described below.

$$X=\Delta X' \cos\theta+\Delta Y' \sin\theta \quad (1)$$

$$Y=-\Delta X' \sin\theta+\Delta Y' \cos\theta \quad (2)$$

<<Detection of Rotation Angle>>

Figure 11:
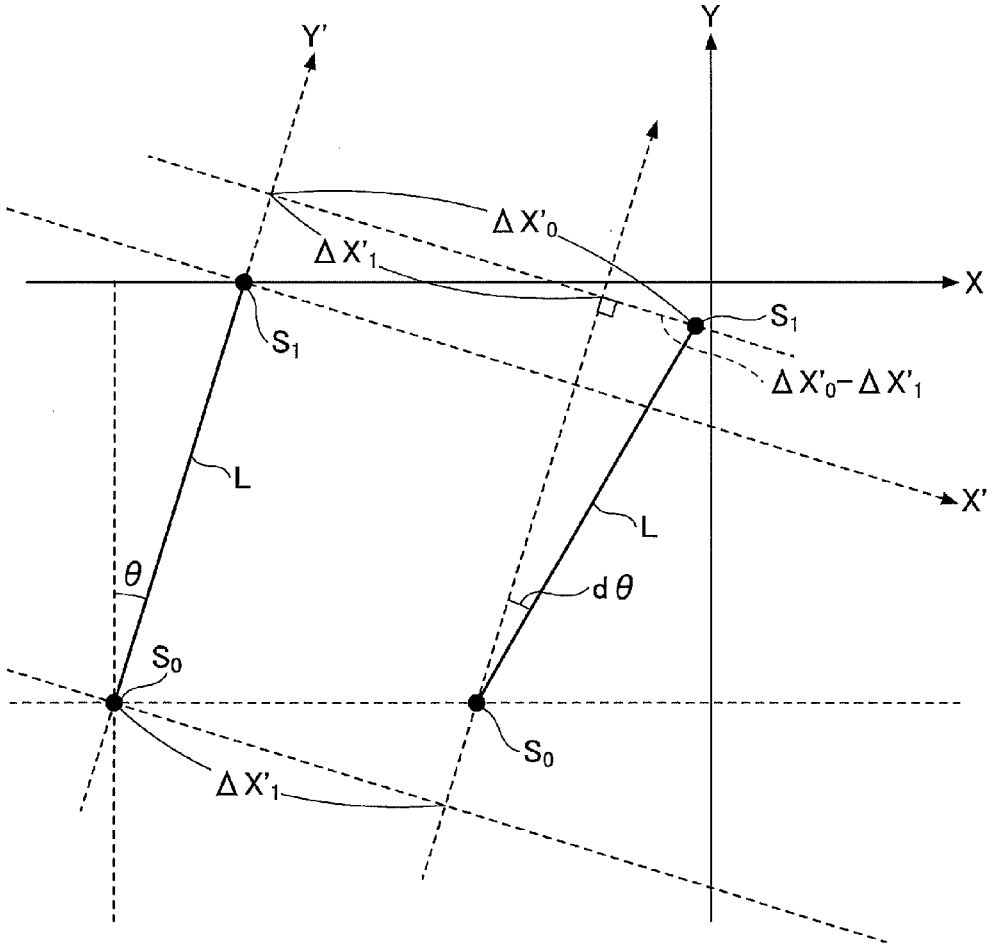
FIG. 11 is a diagram showing an example method of obtaining a rotation angle of a rotation of the handheld printer that occurs during image formation.

In the following, detection of a rotation angle of the handheld printer 20 that rotates during image formation is described with reference to FIG. 11. FIG. 11 is a diagram showing an example method of obtaining a rotation angle dθ of the handheld printer 20 that rotates during image formation. The rotation angle dθ may be calculated based on the displacement ΔX' detected by two navigation sensors $S_0$ and $S_1$. Note that in FIG. 11, $\Delta X'_0$ represents the displacement to be detected by the navigation sensor $S_0$ arranged at the upper side of the print medium 12, and $\Delta X'_1$ represents the displacement to be detected by the navigation sensor $S_1$ arranged at the bottom side of the print medium 12. Also, in FIG. 11, 0 represents the rotation angle that has already been obtained.

In the example shown in FIG. 11, it is assumed that the handheld printer 20 has been rotated by the rotation angle dθ while moving in parallel motion. Thus, in the present example, the displacement $\Delta X'_0$ and the displacement $\Delta X'_1$ are not the same. However, the outputs $\Delta X'_0$ and $\Delta X'_1$ of the navigation sensors $S_0$ and $S_1$ both represent displacements in the X'-axis direction, which is perpendicular to a straight line connecting the positions of the two navigation sensors $S_0$ and $S_1$ (Y'-axis direction), and as such, a difference between the displacement $\Delta X'_0$ and the displacement $\Delta X'_1$ can be obtained by calculating "$\Delta X'_0-\Delta X'_1$". This difference occurs when the handheld printer 20 is rotated by the rotation angle dθ. Thus, assuming L represents the distance between the two navigation sensors $S_0$ and $S_1$, the rotation angle dθ can be expressed by the following formula (3).

$$d\theta=\arcsin\{(\Delta X'_0-\Delta X'_1)/L\} \quad (3)$$

Thus, by calculating the rotation angle dθ of the rotation occurring during image formation at suitable timings based on the above formula (3), the position calculating circuit 23 may determine the rotation angle θ of the handheld printer 20 with respect to the print medium 20 at every sampling period of the navigation sensors $S_0$ and $S_1$. Then, using the rotation angle θ determined at the relevant timing, the position calculating circuit 23 may obtain the print medium coordinate X and Y corresponding to the position of the handheld printer 20 based on the above formulas (1) and (2).

In this way, the position of the handheld printer 20 in terms of the print media coordinates may be calculated. For example, if the position of the navigation sensor $S_0$ is computed as $(X_0, Y_0)$, the position of the navigation sensor $S_1$ may be obtained based on the distance L, using the following formulas. Note, however, that the position of the navigation sensor $S_1$ may also be obtained using the above formulas (1)-(3).

$$X_1=X_0-L\times\sin\theta$$

$$Y_1=Y_0-L\times\cos\theta$$

Note that when the position calculating circuit 32 actually calculates the print medium coordinates $X_0$, $X_1$, $Y_0$, and $Y_1$, in some cases, the position calculating circuit 32 may not necessarily have to directly calculate the values of sin θ, tan θ, and the like.

That is, if the angle θ is sufficiently small (small enough to be regarded as 0), the following may be established: sin θ=tan θ=θ. Because the sampling period of the navigation sensors $S_0$ and $S_1$ for detecting the displacement ΔX' and ΔY' is relatively short, θ may be a relatively small value.

For example, assuming the user is performing a scanning operation at a relatively high scanning rate of 400 mm/s, L=1 inch, and the sampling period is 100 μs, the distance that can be travelled during one sampling period may only be 40 μm, and the handheld printer may only rotate by a rotation angle dθ of 0.0015 (rad). Also, in this case, sin(dθ)=tan(dθ)=0.0015. As in this case, when dθ is sufficiently small, the position calculating circuit 32 may assume sin(dθ)=tan(dθ)=dθ.

<Calibration (Pre-Scan)>

Figure 12:
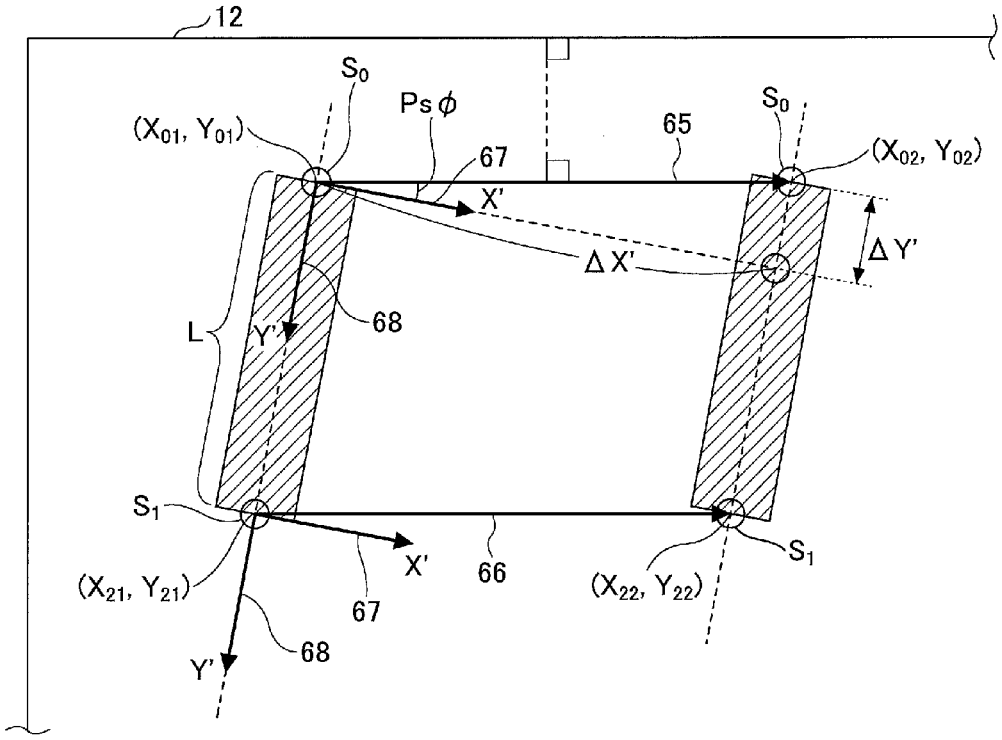
FIG. 12 is a diagram showing an example method of obtaining the skew of the handheld printer at the initial position through calibration.

In the following, calibration for determining the skew Psφ of the handheld printer 20 at the initial position is described with reference to FIG. 12. FIG. 12 is a diagram showing an example method of obtaining the skew Psφ through calibration.

Note that in typical applications, the horizontal and vertical directions of a handheld printer (e.g., longitudinal direction and a direction perpendicular to the longitudinal direction of the IJ recording head) are defined on the X-Y coordinate system. That is, coordinates used to define the position of the handheld printer directly correspond to the print medium coordinates. However, in such applications, when the handheld printer is skewed at the initial position, an image formed by the handheld printer will be skewed with respect to the print medium.

In the present embodiment, the user performs a pre-scan operation of scanning the handheld printer 20 in a substantially horizontal direction with respect to the print medium 12 in order to detect the skew Psφ of the handheld printer 20 at the beginning of image formation. In this way, the horizontal direction (X-axis direction) of the print medium 12 may be defined, and the skew Psφ of the handheld printer 20 with respect to the print medium 12 may be obtained before image formation.

Note that in the following, an example of detecting the skew Psφ based on the position of the navigation sensor $S_0$ is described. However, the skew Psφ may also be detected based on the position of the navigation sensor $S_1$. Before starting image formation, the user performs a pre-scan operation by moving the handheld printer 20 from a pre-scan start point $(X_{01}, Y_{01})$ for the navigation sensor $S_0$. The user moves the handheld printer 20 in a substantially horizontal direction with respect to the print medium 12 until reaching a pre-scan turn-around point $(X_{02}, Y_{02})$. Note that the pre-scan start point is an example of a first position and the pre-scan turn-around point is an example of a second position. Arrow 65 and arrow 66 indicate the trajectory of the pre-scan operation. The pre-scan turn-around point may correspond to an end point of the pre-scan operation. Note that the location of the pre-scan turn-around point is not particularly determined and may be any given point at least a certain distance away from the start point $(X_{01}, Y_{01})$ in the horizontal direction of the print medium 12. Also, in some embodiments, the user may also perform the pre-scan operation in the reverse direction from the pre-scan turn-around point to the pre-scan start point, and the average of the skews Psφ obtained in the forward pre-scan operation and the reverse pre-scan operation may be calculated. In this case, the pre-scan turn-around point corresponds to a position farthest from the start point $(X_{01}, Y_{01})$ in the horizontal direction.

As described above, the displacements output by the navigation sensors $S_0$ and $S_1$ are coordinate values of a coordinate system defined by arrow 67 and arrow 68 respectively corresponding to horizontal and vertical directions of the handheld printer 20 (X'-axis and Y'-axis directions). That is, the navigation sensor $S_0$ outputs the displacement in the direction parallel to the arrow 67 (displacement in the first direction) as displacement ΔX', not the difference between $X_{02}$ and $X_{01}$. Similarly, the navigation sensor $S_0$ outputs the displacement in the direction parallel to the arrow 68 (displacement in the second direction) as displacement ΔY', not the difference between $Y_{02}$ and $Y_{01}$, which will be zero if the displacement is determined based on the print medium coordinates (X-Y coordinate system).

Note that if the skew Psφ is zero, the displacement ΔY' will be zero. According to the above example, the skew Psφ (skew information) of the handheld printer 20 at the initial position may be calculated based on the ratio of ΔY' to ΔX' as indicated by the following formula (4).

$$Ps\varphi=\arctan(\Delta Y'/\Delta X') \quad (4)$$

The skew computing unit 33*a* of the skew calculating/correcting circuit 33 may calculate the skew Psφ in the above-described manner and store the calculated skew Psφ in the DRAM 29 or the like.

Note that although the handheld printer 20 is moved completely parallel to the horizontal direction of the print medium 12 in the example shown in FIG. 12, the straight line connecting the pre-scan start point $(X_{01}, Y_{01})$ and the pre-scan turn-around point $(X_{02}, Y_{02})$ does not necessarily have to be completely parallel to the horizontal direction of the print medium 12. That is, even when the pre-scan turn-around point $(X_{02}, Y_{02})$ slightly deviates from the pre-scan start point $(X_{01}, Y_{01})$ in the horizontal direction, such a deviation may be so small that it is not likely to affect the skew Psφ in terms of correcting the skew Psφ.

Accordingly, even when there is a slight deviation in the scanning direction of the pre-scan operation, skewing of the image with respect to the print medium 12 may be reduced according to the present embodiment.

<Correction of Target Discharge Position>

When the skew Psφ of the handheld printer 20 is obtained, the skew calculating/correcting circuit 33 can correct the target discharge positions.

Figure 13:
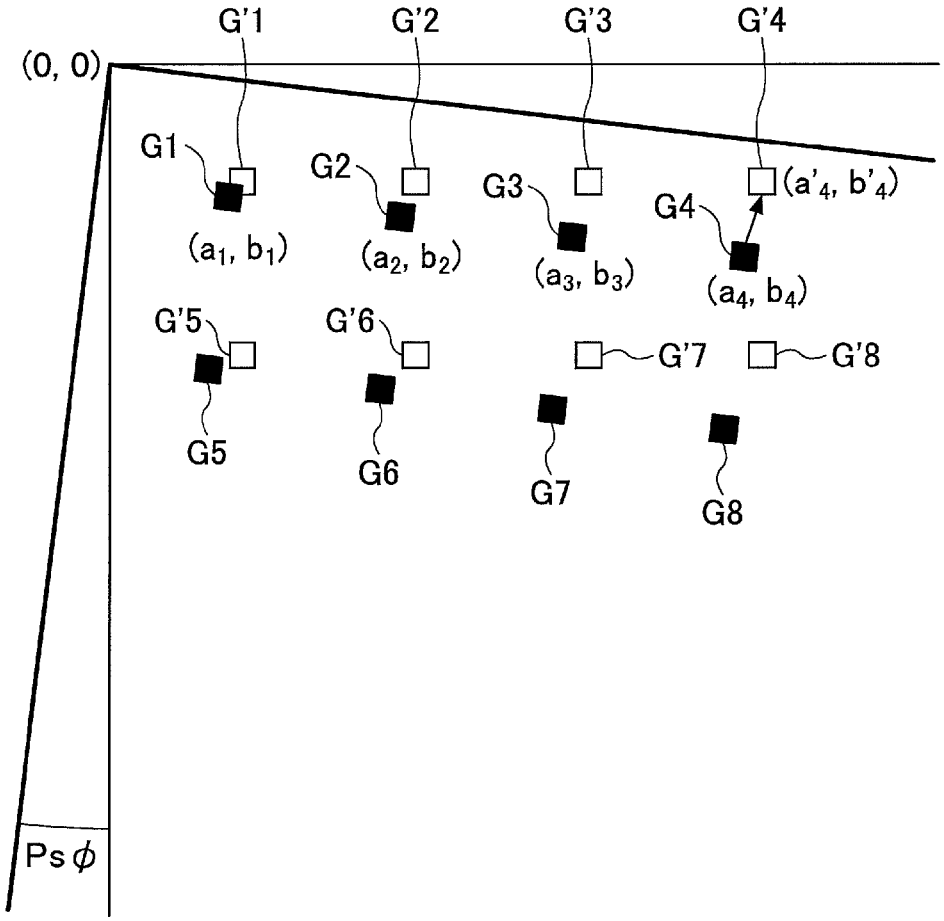
FIG. 13 is a diagram showing an example method of correcting a target discharge position.

FIG. 13 is a diagram showing an example of correcting the target discharge position. In FIG. 13, target discharge positions G1-G8 represent initial target discharge positions before correction. That is, the target discharge positions G1-G8 correspond to initial target discharge positions obtained based on the initial position of the handheld printer 20 that is skewed with respect to the print medium 12 by the skew Psφ. In contrast, target discharge positions G'1-G'8 in FIG. 13 represent corrected target discharge positions after skew correction.

The corrected target discharge positions G'1-G'8 may be calculated by rotating the initial target discharge positions G1-G8 around the initial position (the origin (0, 0)) by the skew Psφ obtained in the pre-scan operation (applying affine transformation for rotation). More specifically, given $a_n$ and $b_n$ represent coordinates of an n-th initial target discharge position Gn, and $a'_n$ and $b'_n$ represent coordinates of an n-th corrected target discharge position G'n, skew correction may be performed using the following formulas (5) and (6).

$$a'n=an\times\cos Ps\varphi-bn\times\sin Ps\varphi \quad (5)$$

$$b'n=an\times\sin Ps\varphi+bn\times\cos Ps\varphi \quad (6)$$

Then, the IJ recording head control unit 43 may perform nozzle discharge determination with respect to the current position of the handheld printer 20 and the corrected target discharge positions G'1-G'8, to discharge ink for forming pixels corresponding to the initial target discharge positions G1-G8 onto the corrected target discharge positions G'1-G'8. In this way, skewing of the image formed by the handheld printer 20 may be controlled.

Figure 14:
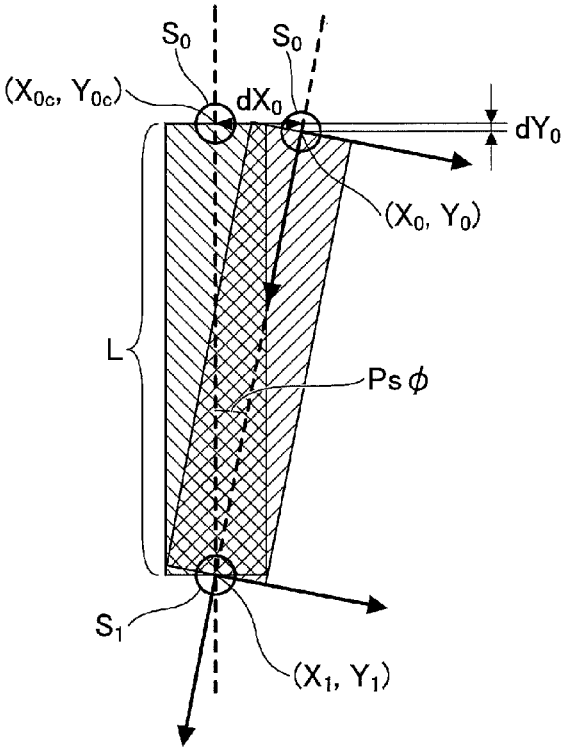
FIG. 14 is a diagram schematically showing an example method of correcting the initial position of the handheld printer based on the skew of the handheld printer.

Note that in some embodiments, the calculation of the target discharge position may be performed after correcting the initial position of the handheld printer 20. FIG. 14 is a diagram schematically showing an example of correcting the initial position of the handheld printer 20 based on the skew Psφ obtained in the pre-scan operation.

In FIG. 14, $(X_0, Y_0)$ represents the coordinates of the initial position of the navigation sensor $S_0$, $(X_1, Y_1)$ represents the coordinates of the initial position of the navigation sensor $S_1$, $(X_{0c}, Y_{0c})$ represents the coordinates of a corrected initial position of the navigation sensors $S_0$, Psφ represents the skew of the handheld printer 20 obtained in the pre-scan operation, and L represents the distance between the navigation sensors $S_0$ and $S_1$. Note that in correcting the initial position of the handheld printer 20, a correction angle Pφ is obtained by reversing the positive/negative sign of the skew Psφ obtained in the pre-scan operation. That is, Pφ is calculated by the following formula.

$$P\varphi=(-1)\times Ps\varphi$$

Note that both Pφ and Psφ are in radians.

A difference $dX_0$ between the X coordinate value of the initial position of the navigation sensor $S_0$ and the X coordinate value of the corrected initial position, in terms of the print medium coordinates, can be expressed by the following formula, assuming Psφ is sufficiently small.

$$dX_0=L\times\sin P\varphi=L\times P\varphi$$

Similarly, a difference $dY_0$ between the Y coordinate value of the initial position of the navigation sensor $S_0$ and the Y coordinate value of the corrected initial position, in terms of the print medium coordinates, can be expressed by the following formula.

$$dY_0=L\times(1-\cos P\varphi)$$

Consequently, the coordinates $(X_{c0}, Y_{0c})$ of the corrected initial position of the navigation sensor $S_0$, and the coordinates $(X_{1c}, Y_{1c})$ of the corrected initial position of the navigation sensor $S_1$ can be obtained by the following formulas (7) and (8).

$$(X_{0c}, Y_{0c})=(X_0+dX_0, Y_0+dY_0) \quad (7)$$

$$(X_{1c}, Y_{1c})=(X_1, Y_1) \quad (8)$$

In this way, the skew calculating/correcting circuit 33 may correct the initial position of the handheld printer 20 based on the skew Psφ obtained in the pre-scan operation and store the corrected initial position in the DRAM 29 or the like. Further, the skew calculating/correcting circuit 33 may calculate the target discharge positions based on the corrected initial position. In this case, the corrected target discharge positions G'1-G'8 shown in FIG. 13 can be obtained directly instead of calculating the corrected target discharge positions G'1-G'8 based on the initial target discharge positions G1-G8.

<Nozzle Position>

Figure 15:
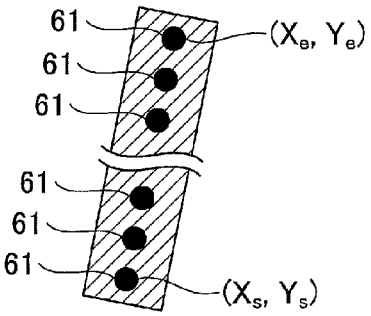
FIG. 15 is a diagram showing an example method of calculating a nozzle position.

FIG. 15 is a diagram showing an example method of calculating the position of an N-th nozzle N. Note that the distances between the nozzles 61 arranged into nozzle array are equal. Also, the relative positions of the nozzles 61 with respect to the navigation sensors $S_0$ and $S_1$ are fixed. Thus, if the current positions of the navigation sensors $S_0$ and $S_1$ are calculated, the position of any given nozzle N of the nozzles 61 can be obtained. That is, assuming $(X_s, Y_s)$ represents the coordinates of the nozzle 61 at the front end of the nozzle array, and $(X_e, Y_e)$ represents the coordinates of the nozzle 61 at the rear end of the nozzle array, the coordinates of the N-th nozzle N may be calculated based on the following formulas.

$$NZLN_X=X_s+N\times\{(X_e-X_s)/(\text{Total Number of Nozzles}-1)\}$$

$$NZLN_Y=Y_s+N\times\{(Y_e-Y_s)/(\text{Total Number of Nozzles}-1)\}$$

<Operation Procedure>

In the following, an example operation procedure of the handheld printer 20 is described with reference to FIGS. 16 and 17. FIGS. 16 and 17 are flowcharts showing an example operation procedure of the handheld printer 20 from activation to the end of image formation. In FIGS. 16 and 17, the left side shows user operations, and the right side shows operations of the handheld printer 20. Note that process operations described below as being performed by the CPU 31 correspond to functions achieved by the CPU 31 executing firmware or the like.

<<Activation>>

In step U101, the user presses the power button 53 of the handheld printer 20.

In steps S101 and S102, power is supplied from the power supply 22 to the handheld printer 20, and the CPU 31 of the SoC 50 performs initialization of components including the ASIC/FPGA 40 to start the respective components.

In step S103, after completing initialization operations, the CPU 31 notifies the user that the handheld printer 20 is ready to be used by turning on the power LED 51, for example.

<<Image Transmission>>

In step U102, the user selects an image to be printed by displaying the image on the image data output device 11, for example.

In step U103, the user inputs an instruction to execute a print job. In turn, an application installed in the image data output device 11 calls a printer driver, and the printer driver describes print conditions and the image in PDL (Printer Description Language) and sends the generated data to the handheld printer 20. Note that in some embodiments, image data in TIFF, JPEG, GIF, or some other format may be transmitted to the handheld printer 20 without using a printer driver, for example.

In S104, the CPU 31 notifies the user that the image is being transmitted by blinking the printing LED 52, for example.

In step S105-1, when the image transmission is completed, the CPU 31 notifies the user that image formation (printing) can be started by turning off the LED 52, for example.

<<Pre-Scan Operation>>

In step U104, the user establishes the initial position (image formation start position) of the handheld printer 20 on the print medium 12.

In step U105, the user presses the print button 54 (first time) at the pre-scan start point (image formation start position established by the user).

In step S105-2, the CPU 31 accepts a key interrupt by the print button 54, and notifies the user that a pre-scan operation is being performed by blinking the printing LED 52, for example. Also, the CPU 31 sends an instruction to the navigation sensor I/F 41 to read the outputs of the navigation sensors $S_0$ and $S_1$.

In step S1001, position information (displacement) is detected by the navigation sensors $S_0$ and $S_1$ and stored in internal memories of the navigation sensors $S_0$ and $S_1$. Note that the handheld printer 20 is not yet moved at this point such that the detected position information (displacement) is zero.

In step S106, the navigation sensor I/F 41 communicates with the navigation sensors $S_0$ and $S_1$ to read the position information (displacement) stored in their internal memories.

In step S107, the CPU 31 stores the position information read by the navigation sensor I/F 41 as a temporary initial position in the DRAM 29 or the like. For example, coordinates of the temporary initial position may be set to (0, 0).

In step U106, the user performs a free-hand pre-scan operation by manually moving the handheld printer 20 in a substantially horizontal direction with respect to the print medium 12 from the pre-scan start point. By performing such a pre-scan operation, the user himself/herself may be able to define the horizontal direction for an image forming operation. The scanning distance of the handheld printer 20 in the pre-scan operation may be any given distance. However, the scanning distance is preferably arranged to be as long as possible in view of its influence on the skew Psφ to be calculated later.

In step U107, when the user determines that the handheld printer 20 has reached the pre-scan turn-around point, the user presses the print button (second time). Note that in some embodiments, the user may not have to press the print button 54, and the handheld printer 20 may automatically determine that the skew calculating/correcting circuit 33 has reached the pre-scan turn-around point when the moving distance from the start point exceeds a threshold value, for example.

In step S108, the CPU 31 accepts a key interrupt by the print button 54 and notifies the user that the pre-scan operation has been completed by turning off the print LED 52, for example. Also, the CPU 31 sends an instruction to the navigation sensor I/F 41 to read the position information (displacement) detected by the navigation sensors $S_0$ and $S_1$.

In step S1002, position information (displacement) is detected by the navigation sensors $S_0$ and $S_1$ and stored in the internal memories of the navigation sensors $S_0$ and $S_1$.

In step S109, the navigation sensor I/F 41 communicates with the navigation sensors $S_0$ and $S_1$ to read the position information (displacement) stored in their internal memories.

In step S110, the skew calculating/correcting circuit 33 applies the above formula (4) to the temporary initial position (0, 0) corresponding to the pre-scan start point and the displacement (ΔX', ΔY') read by the navigation sensor I/F 41 to calculate the skew Psφ of the handheld printer 20 at the pre-scan start point (initial position). The calculated skew Psφ is stored in the DRAM 29 or the like.

<<Image Forming Operation>>

In step U109, to perform an image forming operation, the user manually moves the handheld printer 20, free-hand, to the pre-scan start point (initial position) and presses the print button 54 (third time). Note that the pre-scan start point and the image formation start position do not have to be exactly the same. However, the skew angle of the handheld printer 20 at the pre-scan start point and the skew angle the image formation start position are preferably about the same.

In step S110-1, the skew calculating/correcting circuit 33 corrects the target discharge positions calculated by the position calculating circuit 32 based on the skew Psφ obtained in the pre-scan operation.

In step S111, the CPU 31 accepts a key interrupt by the print button 54, and during image formation, the CPU 31 notifies the user that an image forming operation is being performed by turning on the print LED 52, for example. Also, the CPU 31 sends an instruction to the navigation sensor I/F 41 to read the position information (displacement) detected by the navigation sensors $S_0$ and $S_1$.

In step S1003, position information (displacement) is detected by the navigation sensors $S_0$ and $S_1$ and stored in the internal memories of the navigation sensors $S_0$ and $S_1$. Note that at this point, the handheld printer 20 is not yet moved from the image formation start position such that the position information (displacement) is zero.

In step S112, the navigation sensor I/F 41 communicates with the navigation sensors $S_0$ and $S_1$ to read the position information (displacement) stored in their internal memories.

Note that in a case where the target discharge positions are to be corrected after correcting the initial position, the process of step S110-1 may be omitted, and the process of step S113 may be performed at this point. In step S113, the skew calculating/correcting circuit 33 applies the above formulas (5) and (6) to the skew Psφ obtained in the pre-scan operation and the initial position (substantially zero) read by the navigation sensor I/F 41 to correct the initial position and stores the corrected initial position in the DRAM 29 or the like. Then, the target discharge positions are calculated based on the corrected initial position.

Then, in steps S114 and S115, the CPU 31 causes the print/sensor timing generating unit 42 to start time measurement (for measuring the drive period of the IJ recording head 24).

In step S116 the print/sensor timing generating unit 42 repeatedly signals the navigation sensor I/F 41 to read the position information stored in the navigation sensors 30 at preset time intervals. The CPU 31 detects an interrupt and reads the position information (displacement) detected by the navigation sensors 30 from the ASIC/FPGA 40.

In step S117, the position calculating circuit 32 calculates current position information (X, Y) of each navigation sensor 30 based on previously calculated position information ($X_0$, $Y_0$) and the displacement ($\Delta X'$, $\Delta Y'$) read by the CPU 31 and stores the calculated current position information (X, Y) in the DRAM 29 or the like. That is, the position calculating circuit 32 calculates the rotation angle de using the above formula (3), and calculates the current position information (X, Y) in terms of the print medium coordinates using the above formulas (1) and (2). The CPU 31 conveys the current position information of each of the navigation sensors $S_0$ and $S_1$ calculated by the position calculating circuit 32 to the ASIC/FPGA 40.

In step S119, the DMAC 37 reads image data surrounding the nozzles from the DRAM 29 or the like. That is, the DMAC 37 reads image data of an image to be formed around the current position of the IJ recording head 24 (nozzles 61) based on the current position information calculated by the position calculating circuit 32. Also, the rotator 38 rotates the image based on the rotation angle θ.

Then, in steps S120 and S121, the IJ recording head control unit 43 determines whether each nozzle position is within the allowable error range 62 from the target discharge positions to determine whether a discharge condition for discharging ink is satisfied.

If a given nozzle position is within the allowable error range with respect to a given target position, the IJ recording head control unit 43 determines that the discharge condition is satisfied for the nozzle, and in step S122, the IJ recording head control unit 43 outputs a control signal to the IJ recording head drive circuit 23 for discharging ink corresponding to a pixel to be formed at the target discharge position.

By repeating the processes of steps S114-S122 as described above, the handheld printer 20 can form an image on the print medium 12.

In step S123, the CPU 31 determines whether all the data have been discharged. Such a determination may be made based on whether there is image data that has not been read or transmitted from the DRAM 29, for example.

In S124, when it is determined that all the data has been discharged, the CPU 31 notifies the user by turning off the print LED 52, for example.

Also, in step U111, the user may press the print button 54 to terminate the image forming operation at the user's discretion even before all the data has been discharged.

<<Power Off>>

In step U112, the user presses the power button 53 of the hand-held printer 20 to turn off the power of the handheld printer 20. The CPU 31 accepts the key interrupt by the power button 53 and turns off the power supply 22.

<Status Transition>

Figure 18:
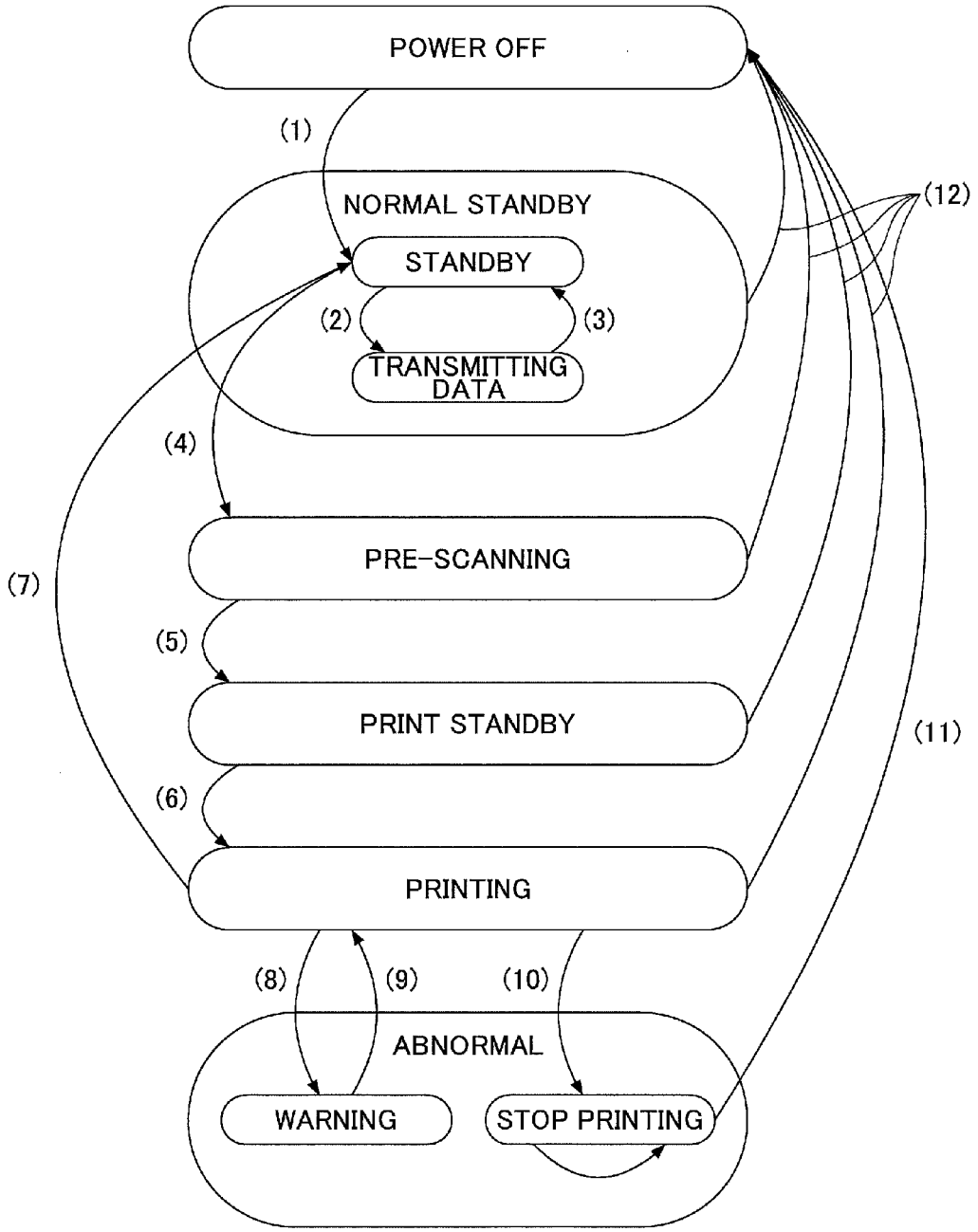
FIG. 18 is a diagram showing an example transition of the operation status of the handheld printer including a pre-scanning operation status.

FIG. 18 is a diagram showing an example transition of the operation status of the handheld printer 20 including a pre-scanning operation status.

(1) When the user presses the power button 53, the operation status of the handheld printer 20 transitions from "power off" to "normal standby".

(2) When the image data output device 11 starts transmitting image data to the handheld printer 20 while the handheld printer 20 is in "standby" mode of "normal standby", the operation status of the handheld printer 20 transitions to "transmitting data" mode.

(3) While the handheld printer 20 is in "transmitting data" mode of "normal standby", when the transmission of image data is completed, the operation status of the handheld printer 20 transitions back to "standby" mode of "normal standby". Once the handheld printer 20 transitions to "transmitting data" mode, a transition flag is set up for enabling the handheld printer 20 to transition to "pre-scanning" mode. On the other hand, if the handheld printer 20 has not gone through the "transmitting data" mode, the transition flag will not be set up, and as such, the operation status of the handheld printer 20 in the "standby" mode cannot be switched to "pre-scanning" mode even when the user presses the print button 54.

(4) While the handheld printer 20 is in "standby" mode of "normal standby" after completion of the image data transmission, when the user moves the handheld printer 20 to the initial position and presses the print button 54, the operation status of the handheld printer 20 transitions to "pre-scanning" mode.

(5) While the handheld printer 20 is in "pre-scanning" mode, the user performs a pre-scan operation, and when the handheld printer 20 reaches the pre-scan turn-around point, the user may press the print button 54 so that the operation status of the handheld printer 20 transitions to "print standby" mode.

(6) While the handheld printer 20 is in "print standby" mode, when the user moves the handheld printer 20, freehand, to the image formation start position (initial position) and presses the print button 54, the operation status of the handheld printer 20 transitions to "printing" mode.

(7) When the user presses the print button 54 while the handheld printer 20 is in "printing" mode, or when ink discharge has been completed with respect to all of the image data, the operation status of the handheld printer 20 transitions back to "normal standby" mode.

(8) In the event an abnormal condition that needs to be notified to the user occurs while the handheld printer 20 is in "printing" mode, the operation status of the handheld printer 20 may transition to "warning" mode of "abnormal" status.

(9) When the handheld printer 20 transitions to "warning" mode of "abnormal" status, the CPU 31 issues a relevant warning to the user using a log display or the like. Thereafter, the operation status of the handheld printer 20 may transition back to "printing" mode, and the image forming operation may be resumed.

(10) In the event an error occurs while the handheld printer 20 is in "printing" mode, the operation status of the handheld printer 20 transitions to "stop printing" mode of "abnormal" status.

(11) When the handheld printer 20 is in "stop printing" mode of "abnormal" status, the user may press the power button 53 for a prolonged time to switch the operation status of the handheld printer 20 to "power off".

(12) Note that the user may similarly press the power button 53 for a prolonged time to switch the operation status of the handheld printer 20 to "power off" from the "normal standby" mode, the "pre-scanning" mode, the "print standby" mode, and the "printing" mode.

As described above, by correcting the target discharge positions based on the skew Psφ of the handheld printer 20 at the initial position, skewing of an image formed on the print medium 12 may be controlled even when the IJ recording head 24 is skewed with respect to the print medium 12 at the initial position.

Second Embodiment

In the first embodiment described above, skewing of an image to be formed can be controlled by correcting the target discharge positions based on the skew Psφ of the handheld printer 20 at the initial position. In the handheld printer 20 according to a second embodiment of the present invention, skew correction (image correction) is implemented with respect to image data that has not been converted into dot data to be used for discharging ink (for forming pixels). In this way, the handheld printer 20 according to the present embodiment can control skewing of an image to be formed on the print medium 12.

Figure 19A:
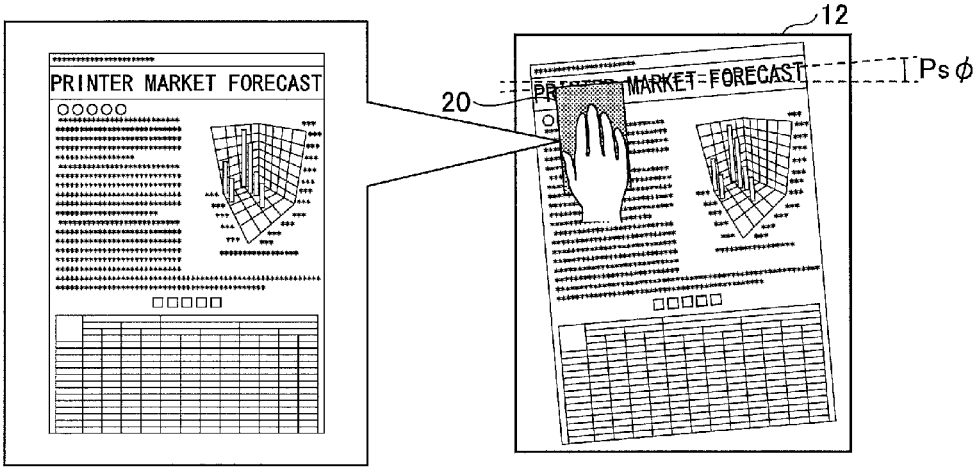
FIGS. 19A and 19B are diagrams showing another example method of correcting the skew of the handheld printer at the initial position.
Figure 19B:
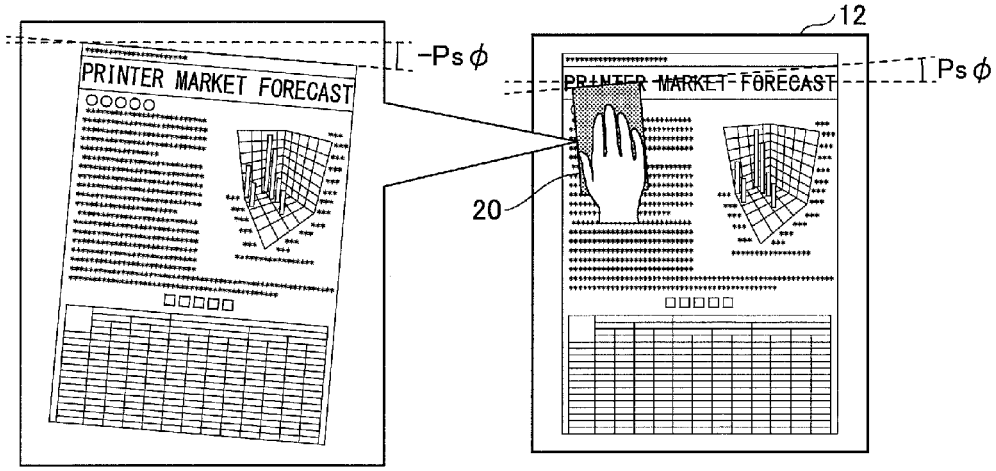

FIGS. 19A and 19B are diagrams explaining the skew correction (image correction) implemented by the handheld printer 20 according to the present embodiment. In FIG. 19A, the handheld printer 20 is skewed with respect to the print medium 12 by the skew Psφ at the initial position. Thus, if the skew Psφ is not corrected as in the first embodiment, an image formed on the print medium 12 will also be skewed.

In the present embodiment, as shown in FIG. 19B, image data of an image to be formed (printed) is rotated by −Psφ. In this way, even when the handheld printer 20 is skewed at the initial position, an image formed on the print medium may be prevented from being skewed.

Note that the configuration of the control unit 25 of the handheld printer 20 according to the present embodiment may be substantially identical to that of the first embodiment as shown in FIGS. 5 and 6. In the following descriptions of the present embodiment, elements having similar or identical features and/or functions as those of the first embodiment are given the same reference numerals and overlapping descriptions thereof may be omitted.

The skew computing unit 33*a* of the skew calculating/correcting circuit 33 of the present embodiment obtains the skew Psφ of the handheld printer 20 at the initial position by performing a pre-scan operation in a manner similar to the first embodiment. On the other hand, the correction calculating unit 33*b* of the present embodiment performs skew correction with respect to image data stored in the DRAM 29.

Figure 20A:
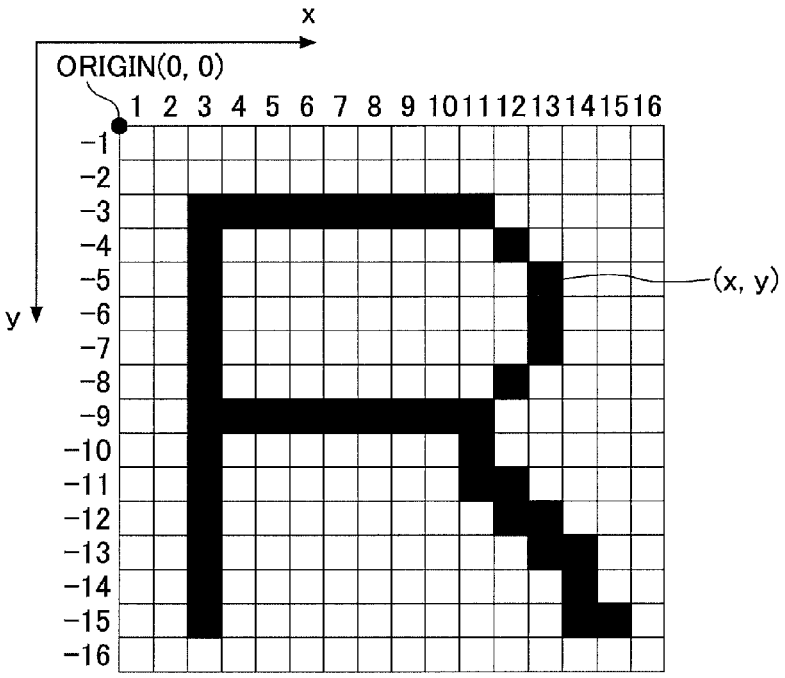
FIGS. 20A and 20B are diagrams showing an example skew correction method for correcting the skew of image data.
Figure 20B:
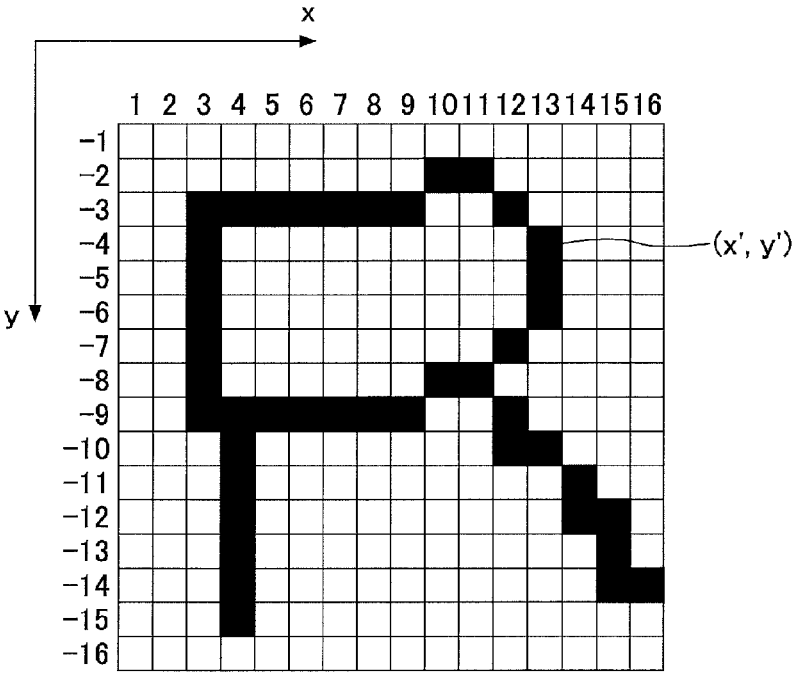

In the following, skew correction of image data is described with reference to FIGS. 20A and 20B. FIGS. 20A and 20B are diagrams showing examples of original image data and image data that has been rotated to correct the skew Psφ. FIG. 20A shows image data of the letter "R" as an example of image data stored in the DRAM 29. The handheld printer 20 receives image data transmitted from the image data output device 11, and the control unit 25 loads the image data into the DRAM 29 as bitmap data. Note that if the image data is compressed at the time of transmission, the control unit 25 may decompress the image data as necessary.

The correction computing unit 33*b* of the skew calculating/correcting circuit 33 according to the present embodiment rotates this image data based on the skew Psφ obtained by the pre-scan operation.

Assuming a given point (x, y) that is rotated by −Psφ around an origin (0, 0) moves to point (x', y'), the point (x y') can be obtained by the following formulas (9) and (10) (affine transformation for rotation).

$$x'=x\times\cos(-Ps\varphi)-y\times\sin(-Ps\varphi) \quad (9)$$

$$y'=x\times\sin(-Ps\varphi)+y\times\cos(-Ps\varphi) \quad (10)$$

FIG. 20B shows image data of the letter "R" that has been rotated by −Psφ. By rotating each pixel of the image data as shown in FIG. 20B, an image formed on the print medium 12 may be prevented from being skewed. Note that although only a portion of the letter "R" appears to be rotated in FIG. 20B, this is merely due to the resolution and the distance of each pixel from the origin.

By rotating each pixel of image data according to the skew Psφ obtained in the pre-scan operation, an image formed on the print medium 12 may be prevented from being skewed even when the handheld printer 20 is skewed with respect to the print medium at the initial position when it starts an image forming operation.

Note that although skew correction of the image data is performed by the correction computing unit 33*b* in the above-described example, in other embodiments, the rotator 38 may rotate image data stored in the image RAM 36, for example. Also, skew correction of the image data may be performed by the DMAC 37, for example. Also, the image data output device 11 may rotate the image data, for example.

<Operation Procedure>

FIGS. 21 and 22 are flowcharts showing an example operation procedure of the handheld printer 20 according to the present embodiment. Note that process steps of FIGS. 21 and 22 that are substantially identical to those shown in FIGS. 16 and 17 are given the same reference numerals and overlapping descriptions are omitted. In the following, process operations of the present embodiment that vary from those of the first embodiment are described.

When the user presses the print button 54 in step U109, the process proceeds to step S110-2 where the correction computing unit 33*b* performs skew correction with respect to image data. That is, in the present embodiment, the correction computing unit 33*b* does not correct the target discharge positions. Note that skew correction of the image data may be performed at any suitable time before image formation.

Note that processes of steps S111 and S112 performed after step S110-2 may be substantially identical to those of the first embodiment. However, in the present embodiment, the process of step S113 for correcting the initial position is not performed. Subsequent processes may also be substantially identical to those of the first embodiment.

As described above, the handheld printer 20 according to the present embodiment corrects image data based on the skew Psφ of the handheld printer 20 at the initial position, and in this way, the handheld printer 20 according to the present embodiment can control skewing of an image to be formed on the print medium 12 even when the IJ recording head 24 is skewed with respect to the print medium 12 at the initial position.

Note that the handheld printer 20 described above is an example embodiment of an image forming apparatus according to the present invention. Also, the navigation sensor 30 is an example embodiment of a displacement detecting unit, the skew computing unit 33*a* is an example embodiment of a skew information acquiring unit, and the correction computing unit 33*b* is an example embodiment of a skew controlling unit. Also, an image forming unit according to the present invention may be embodied by the IJ recording head drive circuit 23, the IJ recording head control unit 43, and the IJ recording head 24, for example. Further, the position calculating unit 32 is an example embodiment of a current position detecting unit according to the present invention, and the DRAM 29 is an example embodiment of an image storage unit according to the present invention.

Other Application Examples

Although the present invention has been described above with reference to certain illustrative embodiments, the present invention is not limited to these embodiments, and numerous variations and modifications may be made without departing from the scope of the present invention.

For example, the components of the SoC 50 and the ASIC/FPGA 40 may be moved from one to the other according to the CPU performance or the circuit scale of the ASIC/FPGA 40, for example.

Also, in the above descriptions, a correction method according to an embodiment of the present invention is applied to the handheld printer 20 that detects positions in three directions, such as the X-axis direction, the Y-axis direction, and the R (rotation)-axis direction, and is configured to be freely moved on a plane to form an image (free-hand scanning). However, a correction method according to an embodiment of the present invention may also be applied to a handheld printer that detects a position in one direction (e.g. X-axis direction) and can only be moved in one direction in forming an image, for example, provided the skew Psφ of such a handheld printer can be detected. Also, a correction method according to an embodiment of the present invention may be applied to a handheld printer that detects positions in two directions, such as the X-axis direction and the Y-axis direction, and can only be moved in two directions in forming an image, for example, provided the skew Psφ of such a handheld printer can be detected.

Also, although an image is formed by discharging ink in the above-described embodiments, other embodiments of the present invention include forming an image by irradiating visible light, ultraviolet light, infrared light, laser, and the like. In such case, a medium that reacts to heat or light may be used as the print medium 12, for example. Also, embodiments of the present invention include forming an image by discharging a clear liquid, for example. In such case, the visible information may be obtained when light of a specific wavelength is irradiated on a medium, for example.

Also, although the pre-scan operation in the above-described embodiments is performed by the user manually moving the handheld printer 20, free-hand, the pre-scan operation may also be performed by moving the handheld printer 20 in a straight line using a ruler or the like.

Also, although the user manually moves the handheld printer 20, free-hand, upon performing a pre-scan operation or an image forming operation in the above-described embodiments, the present invention may also be applied to a handheld printer that is driven and moved by a motor or the like along a print medium. Such a handheld printer may be moved more precisely in the horizontal direction during the pre-scan operation, and as such, the skew of an image may be more accurately corrected, for example.

What is claimed is:

1. An image forming apparatus comprising:

sensor configured to detect a displacement of the image forming apparatus with respect to a first direction and a second direction, the first direction and the second direction being parallel to a surface of a print medium;

a control unit configured to output a control signal for controlling liquid discharge; and a discharge unit configured to discharge liquid on to the print medium based on the control signal, wherein the control unit executes a pre-scan operation that includes processes of detecting a preliminary detected displacement of the image forming apparatus with respect to the first direction and the second direction, before the image forming apparatus begins discharging liquid in accordance with the control signal, the preliminary detected displacement being a displacement from a straight line having endpoints defined by a first position, at which image formation commences, and a second position, which is spaced apart from the first position in a horizontal direction of the print medium, when movement from the first position to the second position is detected, and calculating skew information of the image forming apparatus at the first position based on the preliminary detected displacement, and corrects a liquid discharge position calculated with the first position based on the skew information.

2. The image forming apparatus according to claim 1, further comprising:

an image storage unit configured to store an image to be formed on the print medium;

wherein the control unit implements image correction with respect to the image stored in the image storage unit by tilting the image in a direction opposite to a skew direction of the image forming apparatus based on the skew information of the image forming apparatus; and forms the corrected image that has been subjected to the image correction on the print medium.

3. The image forming apparatus according to claim 2, wherein the control unit implements the image correction with respect to the image stored in the image storage unit by rotating the image in the direction opposite to the skew direction of the image forming apparatus around the first position.

4. The image forming apparatus according to claim 1, wherein the control unit accepts a predetermined operation; and determines the first position and the second position based on a position of the image forming apparatus at the time the control unit accepts the predetermined operation.

5. The image forming apparatus according to claim 1, wherein the control unit sets the second position to a position that is farthest from the first position in the horizontal direction of the print medium.

6. The image forming apparatus according to claim 1, wherein the displacement in the second direction corresponds to a displacement in a direction parallel to a nozzle alignment direction of a plurality of nozzles that output liquid from the image forming apparatus;

the displacement in the first direction corresponds to a displacement in a direction perpendicular to the nozzle alignment direction of the plurality of nozzles; and the control unit acquires the skew information of the image forming apparatus based on a ratio of the displacement in the second direction to the displacement in the first direction.

7. The image forming apparatus according to claim 1, wherein the control unit calculates the skew information of the image forming apparatus at the first position based on the displacement of the image forming apparatus with respect to the first direction and the second direction when the image forming apparatus is moved from the first position to another position.

8. The image forming apparatus according to claim 1, wherein the control unit calculates the control signal based at least in part on the skew information such that a liquid discharge position at the first position corresponding to a pixel position of an image to be formed is rotated around the first position of the image forming apparatus.

9. An image forming method implemented by an image forming apparatus, the image forming method comprising:

detecting a preliminary detected displacement of the image forming apparatus with respect to a first direction and a second direction, before the image forming apparatus begins discharging liquid in accordance with a control signal for controlling liquid discharge, the preliminary detected displacement being a displacement from a straight line having endpoints defined by a first position, at which image formation commences, and a second position which is spaced apart from the first position in a horizontal direction of the print medium, when movement from the first position to the second position is detected, and the first direction and the second direction being parallel to a surface of a print medium;

calculating skew information of the image forming apparatus at the first position based on the detected preliminary detected displacement;

correcting a liquid discharge position calculated with the first position based on the skew information;

outputting the control signal for controlling liquid discharge, the control signal being output based on the corrected liquid discharge position, which corresponds to a pixel position of an image to be formed, the pixel position being rotated around the first position; and discharging liquid on the print medium based on the control signal.

10. The image forming method according to claim 9, wherein the skew information of the image forming apparatus at the first position is calculated based on the displacement of the image forming apparatus with respect to the first direction and the second direction when the image forming apparatus is moved from the first position to another position.

11. A non-transitory computer-readable medium storing a program that is executable by an image forming apparatus, the computer program, when executed, causing the image forming apparatus to implement processes of detecting a preliminary detected displacement of the image forming apparatus with respect to a first direction and a second direction, before the image forming apparatus begins discharging liquid in accordance with a control signal for controlling liquid discharge, the preliminary detected displacement being a displacement from a straight line having endpoints defined by a first position, at which image formation commences, and a second position which is spaced apart from the first position in a horizontal direction of the print medium, when movement from the first position to the second position is detected, and the first direction and the second direction being parallel to a surface of a print medium;

calculating skew information of the image forming apparatus at the first position based on the detected preliminary detected displacement;

correcting a liquid discharge position calculated with the first position based on the skew information;

outputting the control signal for controlling liquid discharge, the control signal being output based on the corrected liquid discharge position, which corresponds to a pixel position of an image to be formed, the pixel position being rotated around the first position; and discharging liquid on the print medium based on the control signal.

12. The non-transitory computer-readable medium according to claim 11, wherein the program causes the image forming apparatus to calculate the skew information of the image forming apparatus at the first position based on the displacement of the image forming apparatus with respect to the first direction and the second direction when the image forming apparatus is moved from the first position to another position.

* * * * *